US006155728A

United States Patent [19]

Sakaino et al.

[11] Patent Number: 6,155,728

[45] Date of Patent: Dec. 5, 2000

[54] PRINTER

[75] Inventors: Tsuyoshi Sakaino; Tadashi Yamashita, both of Tokyo, Japan

[73] Assignee: Citizen Watch Co., Ltd., Tokyo, Japan

[21] Appl. No.: 09/254,241

[22] PCT Filed: Jul. 2, 1998

[86] PCT No.: PCT/JP98/02994

§ 371 Date: May 28, 1999

§ 102(e) Date: May 28, 1999

[87] PCT Pub. No.: WO99/01287

PCT Pub. Date: Jan. 14, 1999

[30] Foreign Application Priority Data

| | | | |
|---|---|---|---|
| Jul. 2, 1997 | [JP] | Japan | 9-190759 |
| Jul. 4, 1997 | [JP] | Japan | 9-179281 |
| Jul. 4, 1997 | [JP] | Japan | 9-179282 |

[51] Int. Cl.[7] ..... B41J 11/06; B41J 13/02

[52] U.S. Cl. ..... 400/26; 400/611; 400/617; 400/636.2

[58] Field of Search ..... 400/605, 611, 400/617, 636.2, 184, 185, 567, 568, 569, 615, 23, 26, 34

[56] References Cited

U.S. PATENT DOCUMENTS

| | | | |
|---|---|---|---|
| 3,999,749 | 12/1976 | Zambolin et al. | 400/26 |
| 4,572,418 | 2/1986 | Hirata | 400/636.2 |
| 4,784,504 | 11/1988 | Hamano et al. . | |
| 5,320,437 | 6/1994 | Malke et al. . | |
| 5,364,196 | 11/1994 | Baitz et al. . | |
| 5,382,104 | 1/1995 | Hirono et al. | 400/605 |
| 5,573,337 | 11/1996 | Yasuoka | 400/605 |
| 5,651,623 | 7/1997 | Stodder et al. | 400/605 |
| 5,899,613 | 5/1999 | Koike et al. | 400/605 |

FOREIGN PATENT DOCUMENTS

| | | |
|---|---|---|
| 50-124724 | 10/1975 | Japan . |
| 57-29902 | 6/1982 | Japan . |
| 57-152979 | 9/1982 | Japan . |
| 63-62755 | 3/1988 | Japan . |
| 1-23821 | 7/1989 | Japan . |
| 1-146958 | 11/1989 | Japan . |
| 5-505570 | 8/1993 | Japan . |
| 5-539 | 8/1993 | Japan . |
| 9-109487 | 4/1997 | Japan . |
| 10058778 | 3/1998 | Japan . |

*Primary Examiner*—Eugene Eickholt
*Attorney, Agent, or Firm*—Smith, Gambrell & Russell, LLP

[57] ABSTRACT

A type printer in which deterioration of a platen is prevented by distributing positions of impacts on the platen by a printing head over the whole region of peripheral surface of a cylindrical platen. The drive shafts of a paper feed roller, platen, and tractor are operatively connected to each other by a gear train, and driven by a motor. The gear ratio of gears in the gear train is selected so that the peripheral velocities of the paper feed roller, platen, and tractor agree with each other. The platen rotates in synchronism with the feed velocity of paper fed by the paper feed roller and the tractor, by which the positions of impacts, which are effected by the printing head, are distributed over the whole region on the peripheral surface of the platen. The printer is provided with an approaching/separating mechanism and a pressing force varying mechanism for a pressing roller, which operates in cooperation with the paper feed roller, a paper transfer path switching mechanism for switching a transfer path according to a continuous paper and a cut paper, and a mechanism for controlling a gap between the printing head and the platen.

15 Claims, 25 Drawing Sheets

FIG. 13a
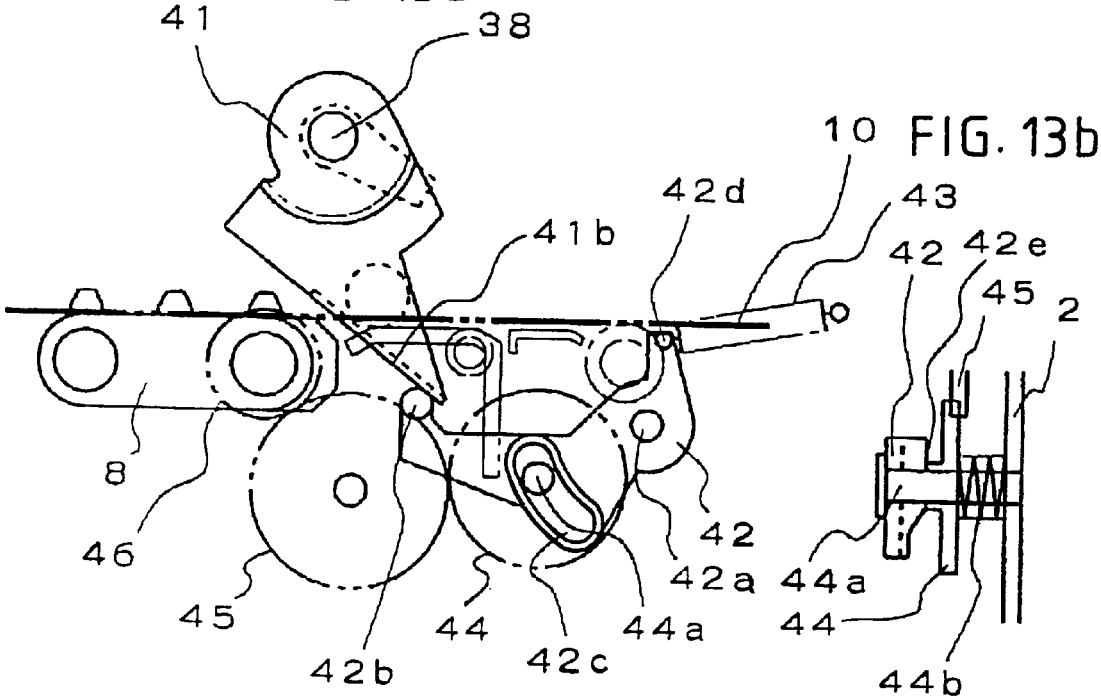
FIG. 13b
FIG. 14a
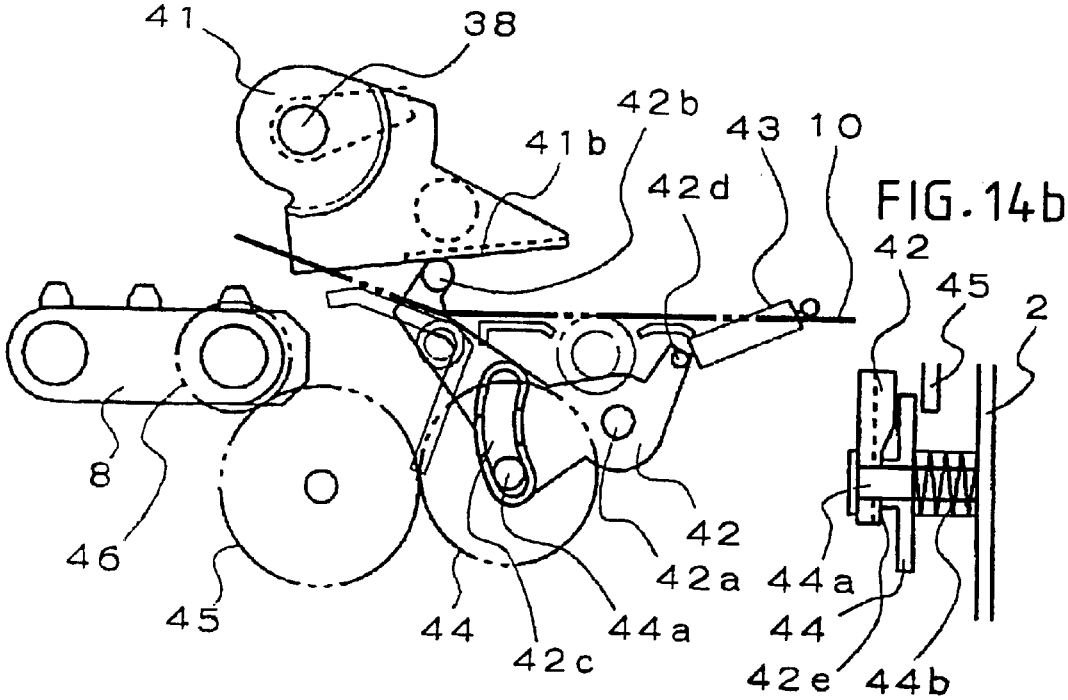
FIG. 14b

PRINTER

TECHNICAL FIELD

The present invention relates to a type impact dot-matrix printer capable of printing on both a continuous paper and a cut paper.

BACKGROUND ART

Conventionally, for a type printer in which a transfer path for printing paper in the vicinity of a printing head is formed on the same flat surface, a flat-plate shaped platen has been used as a platen for performing printing on a paper by being subjected to an impact of a printing head. When such a flat-plate shaped platen is used, there is a problem in that the platen deteriorates early because the position subjected to the impact of the printing head is fixed.

Japanese Patent Publication No. 50-124724 has disclosed a technique such that a cylindrical platen is used in a type printing section provided at the lower part of the printer. However, since a mechanism for causing the cylindrical platen to rotate is not provided, the printing operation in this printing section is always performed at a fixed position of the platen. Also, Unexamined Japanese Patent Publication No. 57-152979 has disclosed a technique such that a substantially cylindrical platen is used in a type printer. However, this platen is formed with a flat surface at the upper part thereof, and this flat surface acts as a surface subjected to the impact of the printing head. Therefore, this platen is completely equal to the flat-plate platen in function.

Generally, a pressing roller of printer is disposed as a pair with a paper feed roller rotated by a rotation driving mechanism. Also, there is provided a pressing spring for pressing the pressing roller on the paper feed roller to rotate the pressing roller in a slave manner.

For a type printer having a continuous paper printing mode and a cut paper printing mode, usually, a cut paper is inserted from the front end of the printer, and a continuous paper is set on a tractor provided at the rear of the printer to be sent out to the front of the printer.

For the type printer, when work of removing a jamming printing paper or removing a printed head mounted on a carriage is performed, the work is difficult to perform because the pressing roller becomes a hindrance.

FIG. 30 is a plan view showing an arrangement of pressing rollers in a paper feeding device for a conventional printer. FIG. 31 is a sectional view taken along the line XXXI—XXXI of FIG. 30.

In FIGS. 30 and 31, reference numeral 51 denotes a printer, which has a pressing roller shaft 73*a* pivotally supported on side frames 52, pressing rollers 73 fixed coaxially to the pressing roller shaft 73*a*, a paper guide 71 for covering the transfer of a printing paper 60 so as to keep clear of the pressing rollers 73, and pressing springs 74 each of which is fixed to the paper guide 71 and the tip end of which presses the pressing roller shaft 73*b* on the side of a paper feed roller 75.

Also, a shaft hole of the side frame 52 on which the pressing rollers 73 are supported pivotally is open so that the pressing rollers can be moved vertically though not shown in the figure.

FIG. 31 shows a state in which the printing paper 60 is fed along a transfer path formed between the paper guide 71 and a transfer plate 59 while being held between the pressing roller 73 and the paper feed roller 75.

With the construction shown in FIGS. 30 and 31, since the printing paper 60 is covered by the paper guide 71, if jamming of the printing paper 60 occurs and part of the printing paper 60 remains, it is very difficult to remove the jamming paper.

Further, for the type printer having a continuous paper printing mode and a cut paper printing mode, a cut paper insertion section, the paper feed roller on the front side, the printing head, the paper feed roller and paper course switching section on the rear side, and the tractor are arranged in series to deliver the paper. Therefore, the depth of printer is increased undesirably.

Also, switching of paper course and a tractor drive transmission mechanism are needed to respond to the continuous paper printing mode and the cut paper printing mode, and the conventional mechanism is very complex.

Japanese Patent Application No. 8-239956 has realized the switching of paper course, the release of tractor drive transmission, and the vertical movement of paper feed roller by the use of a change plate having a complex shape though being a mechanism for driving a motor. However, a considerable distance is needed from the printing head to the position of tractor, so that the depth of printer is inevitably increased.

There have been proposed a various types of printers that can control a distance between the printing head and the platen, that is, the gap of printer head manually or electrically according to the thickness of paper used for printing.

Also, there is known the printer that can select continuous paper and cut paper as the paper used for printing, and can switch the paper course of continuous paper and cut paper manually or electrically.

In some of these printers, the gap control of printing head and the switching of paper course of continuous paper and cut paper are effected electrically. However, the electrical type is usually expensive and used for high-grade printers. On the other hand, since the gap control and the switching of paper course are effected infrequently, in some printers, the gap control and the switching of paper course are effected manually with the body configuration of printer being unchanged, by which the cost is decreased. However, some users who purchased a manual type printer often have a demand for remodeling the gap control mechanism or the paper course switching mechanism to an electrical type as necessary.

In order to meet the aforementioned demand, it is desirable that the manual type can be changed to the electrical type easily merely by installing an electrical power unit additionally. In this case, if the power unit installed for the gap control and the power unit installed for the switching of paper course are the same as a part, the same power unit can be used commonly for the gap control and the switching of paper course, which is preferable because the number of parts can be reduced, and the manufacturing cost and remodeling cost can be decreased.

DISCLOSURE OF INVENTION

An object of the present invention is to provide a flat-bed type printer that can be used without maintenance for a long period of time by preventing the deterioration in a platen.

Another object of the present invention is provide a flat-bed type printer in which a jamming printing paper on a transfer path can be removed easily.

Still another object of the present invention is to provide a flatbed type printer in which a pressing force switching mechanism for a pressing roller, which operates in cooperation with a paper feed roller, is provided, by which the depth of a paper feeding device for a continuous paper and a cut paper is decreased.

Still another object of the present invention is to provide a flatbed type printer in which a power unit installed to drive a gap control mechanism and a power unit installed to drive a paper transfer path switching mechanism are made the same one as a part, which can be commonly used.

The present invention provides a flat-bed type printer, comprising: a paper feeding mechanism for feeding a paper along a substantially straight transfer path; a carriage provided so as to be capable of reciprocating in the direction substantially perpendicular to the direction in which a paper is fed by the paper feeding mechanism; a printing head installed to the carriage; a cylindrical platen disposed so as to be opposed to the printing head; and a driving mechanism for driving the platen and the paper feeding mechanism. The driving mechanism causes the platen to rotate so that the rotation of the platen is in synchronism with the paper feed effected by the paper feeding mechanism, whereby the positions of impacts, which are effected by the printing head, on the peripheral surface of the platen are distributed over the whole region on the peripheral surface of the tin platen.

The paper feeding mechanism has paper feed rollers provided on both sides of the platen in the paper feed direction and pressing rollers, which are provided so as to be opposed to the paper feed rollers, for pressing a paper on the paper feed rollers.

The printer is provided with a tractor for transferring a continuous paper. The printer is provided with a pressing force varying mechanism for making the pressing force of the pressing roller variable. The printer can be switched between a continuous paper printing mode, in which printing is performed on a continuous paper by driving the tractor, and a cut paper printing mode, in which printing is performed on a cut paper without driving the tractor.

The pressing force of the pressing roller differs between the continuous paper printing mode and the cut paper printing mode, and the pressing force is changed in response to the switching between the continuous paper printing mode and the cut paper printing mode. The pressing force of the pressing roller in the continuous paper printing mode is set smaller than the pressing force in the cut paper printing mode.

The printer has a paper transfer path which differs between continuous paper and cut paper, and a paper transfer path switching mechanism for causing the cut paper or the continuous paper to pass through the dedicated paper transfer path. The paper transfer path switching mechanism is switched in response to the switching between the continuous paper printing mode and the cut paper printing mode. The switching of the pressing force of the pressing roller by the pressing force switching mechanism and the switching of the paper transfer path by the paper transfer path switching mechanism are performed at the same time in response to the switching between the continuous paper printing mode and the cut paper printing mode.

The printer has a first frame on which the paper feed roller is supported and a second frame on which the pressing roller is supported. The second frame is supported so as to be rotatable with respect to the first frame, and the pressing roller can be separated from the paper feed roller by rotating the second frame.

The printer is provided with a gap control mechanism which is driven so that the printing head is brought close to or separated from the platen in order to control a gap between the printing head and the platen. A power unit, which is assembled to the gap control mechanism to drive the gap control mechanism, has a motor and a power transmission mechanism supported on a mounting base. The power unit can also be assembled to the paper transfer path switching mechanism, and is configured so as to be capable of driving the paper transfer path switching mechanism.

BRIEF DESCRIPTION OF DRAWINGS

FIG. 13*a* is a sectional view mainly showing a tractor drive transmission mechanism in FIG. 7, and FIG. 13*b* is a partially sectional view of a drive gear shown in FIG. 13*a*;

FIG. 14*a* is a sectional view mainly showing a tractor drive transmission mechanism in FIG. 7, and FIG. 14*b* is a partially sectional view of a drive gear shown in FIG. 14*a*;

FIG. 24 is a schematic side view of a printer 1, shown by seeing through;

FIG. 27 is a schematic side view of a printer, shown by seeing through;

FIG. 28 is a schematic side view of a printer, shown by seeing through;

FIG. 29 is a schematic side view of a printer, shown by seeing through;

BEST MODE OF CARRYING OUT THE INVENTION

Figure 1:
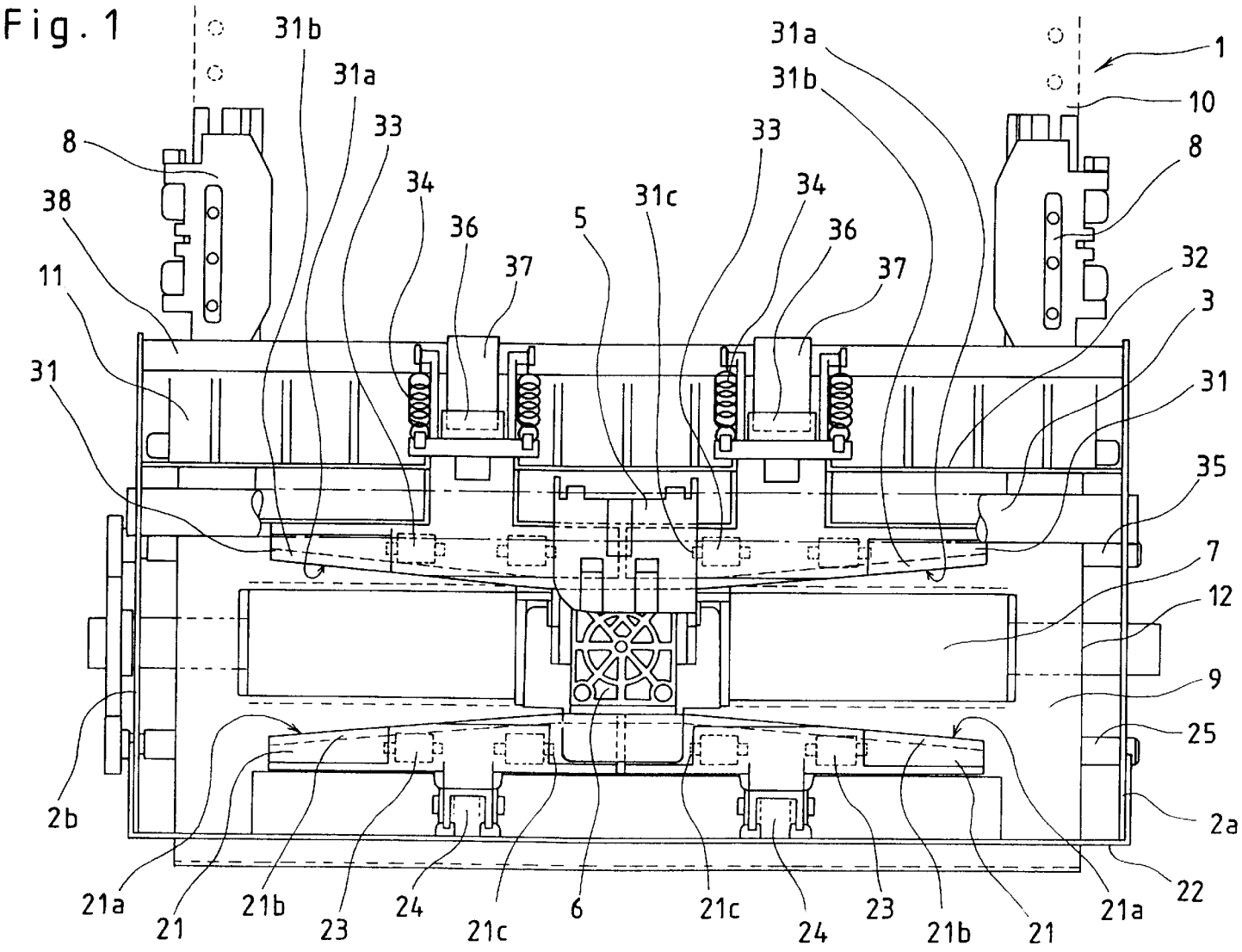
FIG. 1 is a plan view of a principal portion of a printer in accordance with one embodiment of the present invention.
Figure 2A:
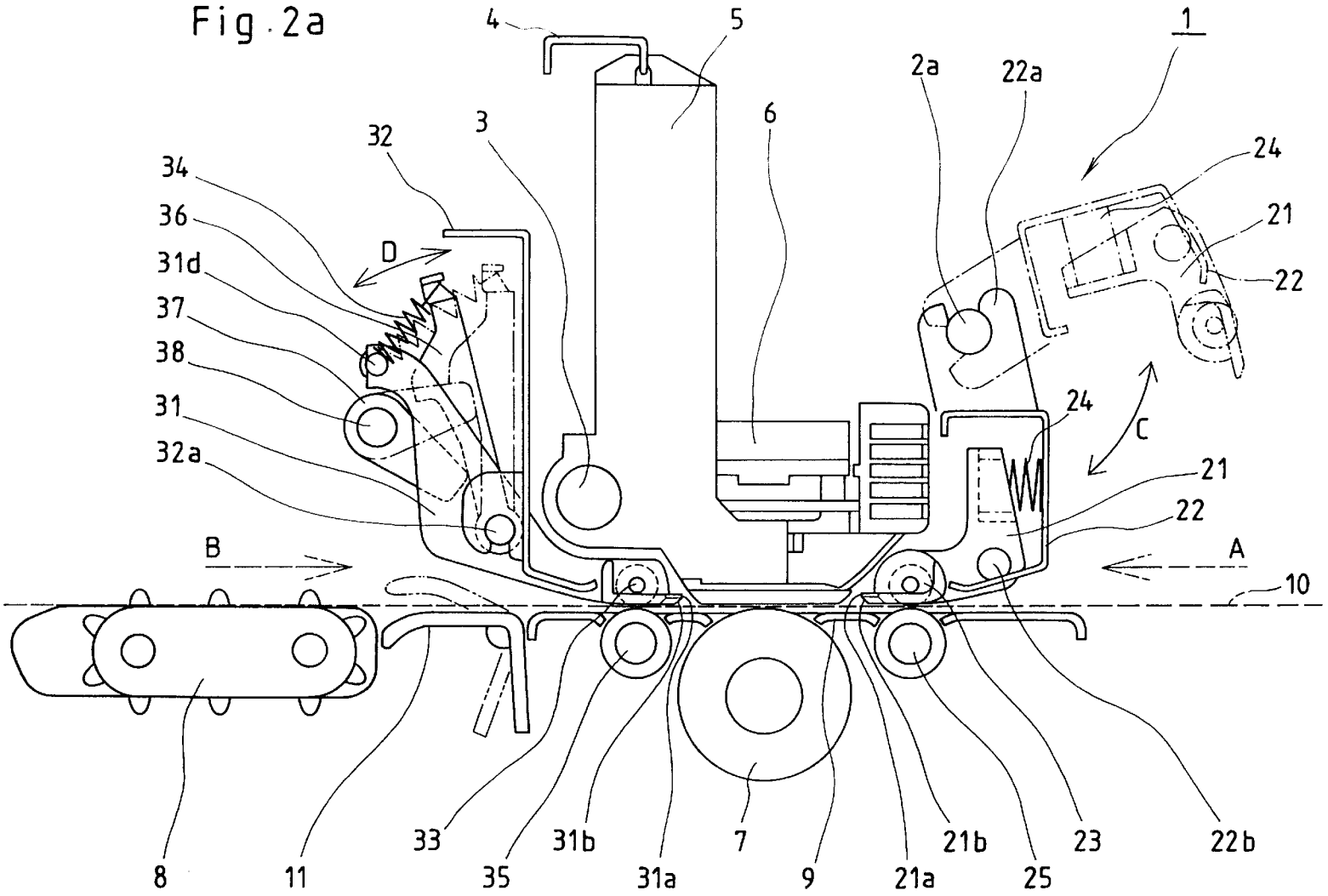
FIG. 2*a* is a sectional view of a principal portion of the printer shown in FIG. 1.

FIG. 1 is a plan view showing a principal portion of a printer in accordance with the present invention, and FIG. 2*a* is a sectional view of FIG. 1.

In FIGS. 1 and 2*a*, a printer 1 includes a carriage 5 which is pivotally supported so as to reciprocate in the axial direction of a carriage shaft 3 by the carriage shaft 3 transversely mounted rotatably to a right side frame 2*a* and a left side frame 2*b* and a carriage guide 4, and a printing head 6 which is removably mounted to the carriage S and reciprocates integrally with the carriage 5. Also, a platen 7 is disposed under the reciprocating printing head 6.

Over a transfer plate 9 for transferring a printing paper 10 arranged in perpendicular to the reciprocating direction of the printing head 6, a first paper guide 21 and a second paper guide 31 are disposed so as to hold the printing head 6 therebetween.

Viewing the first paper guide 21 and the second paper guide 31 from the top, a head opposing portion 21*a*, 31*a* of each paper guide, which is opposed to the printing head 6, is formed in the shape of arc. For each head opposing portion 21*a*, 31*a*, the central part of a transfer path 12 is closest to the printing head 6, and the respective opposite ends are farthest away from the printing head 6. Also, paper guide faces 21*b* and 31*b* are formed on the side of the transfer plate 9 of the head opposing portions 21*a* and 31*a*, respectively.

The first paper guide 21 is divided into two pieces at the center portion. The divided first paper guides 21 each are provided with a roller support portion 21*c*, and a pressing roller 23 is pivotally supported on the roller support portion 21*c* so as to be rotatable.

Also, one end of the first paper guide 21 is pivotally supported by a guide support portion 22*b* provided on a rocking frame 22 so as to be rockable as indicated by the two-dot chain line.

The rocking frame 22 is pivotally supported so as to be rockable by the engagement of a rocking engagement portion 22*a* with a rocking frame support shaft 2*c* provided on the side frame 2.

The other end of the first paper guide 21 is provided with a spring fixing portion 21*d* for fixing one end of a pressing spring 24. The other end of the pressing spring 24 is fixed to a spring fixing portion 22*c* provided on the rocking frame 22. This pressing spring 24 provides an urging force for pressing the pressing roller 23 on a paper feed roller 25.

The second paper guide 31 is, like the first paper guide 21, divided into two pieces at the center portion. At one end of the divided second paper guides 31 each, a roller support portion 31*b* is provided, and a pressing roller 33 is pivotally supported on the roller support portion 31L so as to be rotatable.

Also, the second paper guide 31 is pivotally supported so as to be rotatable by a guide support portion 32*a* provided on a support frame 32 transversely mounted to the side frames 2.

The other end of the second paper guide 31 is provided with a spring fixing portion 31*c* for fixing one end of a pressing spring 34. The other end of the pressing spring 34 is fixed to a spring fixing portion 36*a* provided at the tip end of a rocking member 36 pivotally supported rockably on a support portion (not shown) of the rocking member 36 provided on the second paper guide 31.

On the other hand, a switching cam 37 is fixed to a switching cam shaft 38 transversely mounted to the side frames 2 so as to be rockable, and rocks integrally with the switching cam shaft 38. A tip end portion 37*a* formed at the tip end of the switching cam 37 abuts on an abutting portion 36*b* of the rocking member 36. As indicated by the two-dot chain line, by rocking the switching cam 37 to switch the rocking position, the pressing spring 34 can be extended and contracted by the rocking of the rocking member 36.

Also, at the extension of the transfer plate 9 under the second paper guide 31, a switching plate 11 for switching a paper course of cut paper and continuous paper and a tractor 8 for feeding a continuous paper are disposed.

Figure 2B:
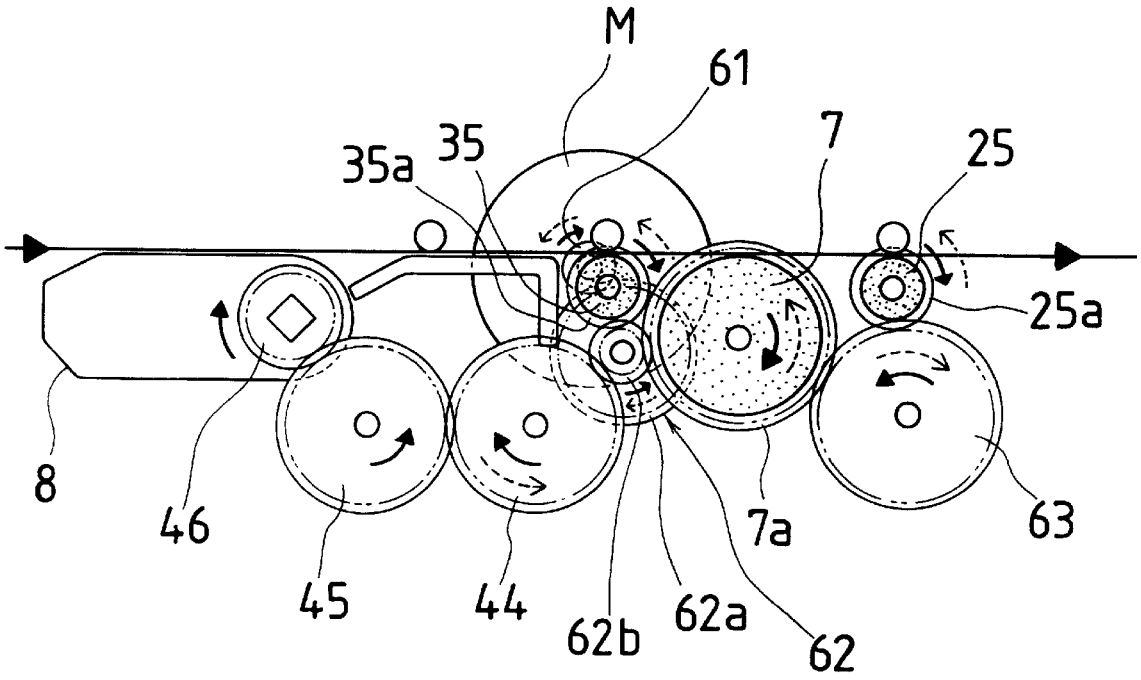
FIG. 2*b* is a schematic view showing a driving mechanism for a platen, paper feed roller, and tractor.

A driving mechanism for the platen, paper feed roller, and tractor will be described with reference to FIG. 2*b*.

As shown in FIG. 2*a*, a platen drive gear 7*a* fixed to the shaft of the platen 7 meshes with a small-diameter gear 62*a* of a first transmission gear 62 and a second transmission gear 63. The small-diameter gear 62*a* of the first transmission gear 62 meshes with a roller drive gear 35*a* fixed to the shaft of a paper feed roller 35, and the second transmission gear 63 meshes with a roller drive gear 25*a* fixed to the shaft of the paper feed roller 25. Further, the small-diameter gear 62*a* meshes with a third transmission gear 44, and the third transmission gear 44 meshes with a fourth transmission gear 45. The fourth transmission gear 45 meshes with a tractor drive gear 46. Therefore, the platen 7 is connected to the paper feed rollers 35 and 25 and the tractor 8 by means of the gear train. These gears 7*a*, 62*a*, 35*a*, 63, 25*a*, 44, 45 and 46 are selected so that the peripheral velocities of the platen 7, paper feed roller 35, and tractor 8 are equal.

The rotation of an output gear 61 installed on the output shaft of a motor M is transmitted to a large-diameter gear 62*a* of the first transmission gear 62. The rotation of the small-diameter gear 62*b* rotating integrally with the large-diameter gear 62*a* is transmitted to the platen drive gear 7*a* and the third transmission gear 44. The rotation of the drive gear 7*a* is transmitted to the roller drive gear 25*a* via the second transmission gear 63. Further, the rotation of the small-diameter gear 62*b* of the second transmission gear is transmitted to the tractor drive gear 46 via the third and fourth transmission gears 44 and 45.

By the aforementioned configuration, the platen 7 is rotated by the operation of the motor M in synchronism with paper feed effected by the paper feed rollers 25 and 35 and the tractor 8. Specifically, when the printing head is operated and printing is actually performed, the platen 7, paper feed rollers 25 and 35, and tractor 8 are stopped. When the printing of one line is finished and paper feed is effected by one line to start the printing of the next line, the platen 7, paper feed rollers 25 and 35, and tractor 8 are rotated in synchronism with each other, whereby the setting position on the paper and the setting position on the platen 7 are shifted by one line. Therefore, the impact positions on the peripheral surface of the platen 7 by the printing head are distributed to the whole region on the peripheral surface of the platen 7.

Next, a pressing roller approaching/separating mechanisms will be described with reference to FIGS. 3 to 6.

Figure 3:
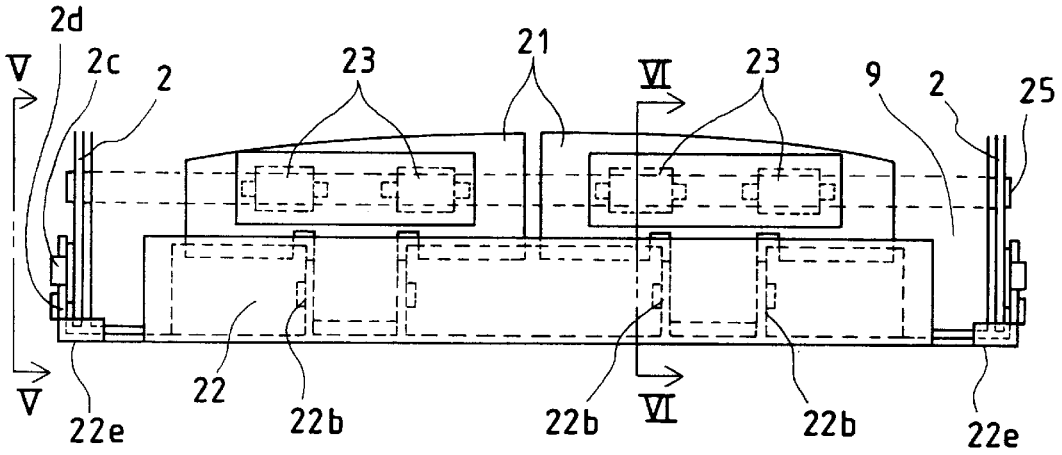
FIG. 3 is a simplified plan view of a principal portion of a first paper guide (roller holding member)
Figure 4:
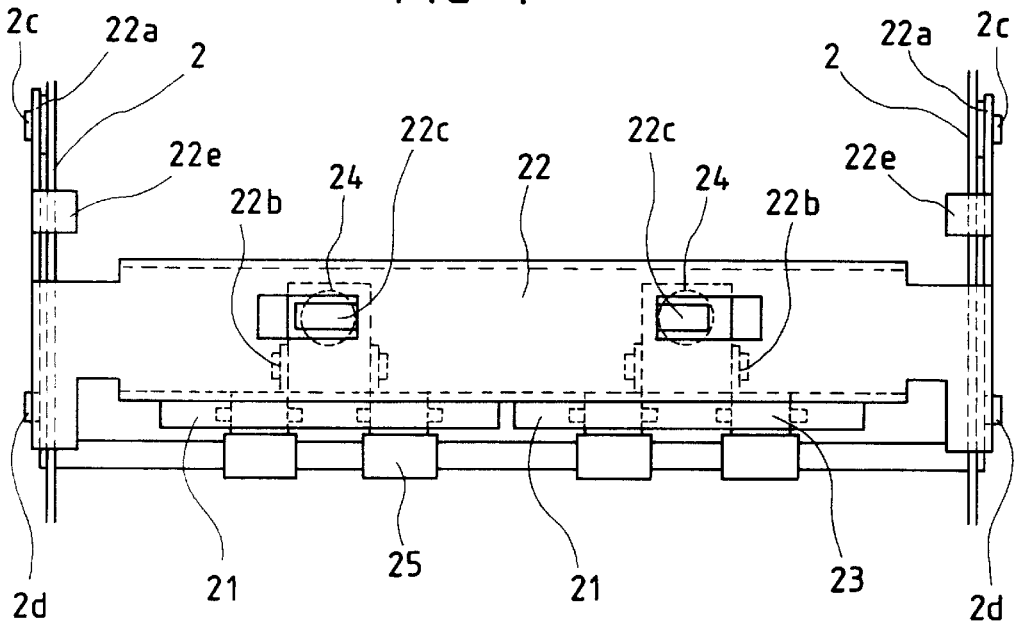
FIG. 4 is a front view of FIG. 3.

FIG. 3 is a simplified plan view of a principal portion of the first paper guide 21 used as a roller holding member in the present invention. FIG. 4 is a front view of FIG. 3. Also, FIG. 5 is a view taken in the direction of the arrows along the line V—V of FIG. 3, and FIG. 6 is a sectional view taken along the line VI—VI of FIG. 3.

In FIGS. 3 to 6, the rocking frame 22 is, at the rocking engagement portion 22*a*, rockably supported by the rocking frame support shaft 2*a* provided on the side frame 2. Also, the rocking frame 22 is positioned by the rocking frame support shaft 2*a* and a positioning pin 2*d* provided on the side frame 2.

As shown in FIG. 4, the front surface of the rocking frame 22 is formed with two openings. In the opening, the tongue-shaped spring fixing portion 22*c* is formed to fix one end of the pressing spring 24.

Figure 5:
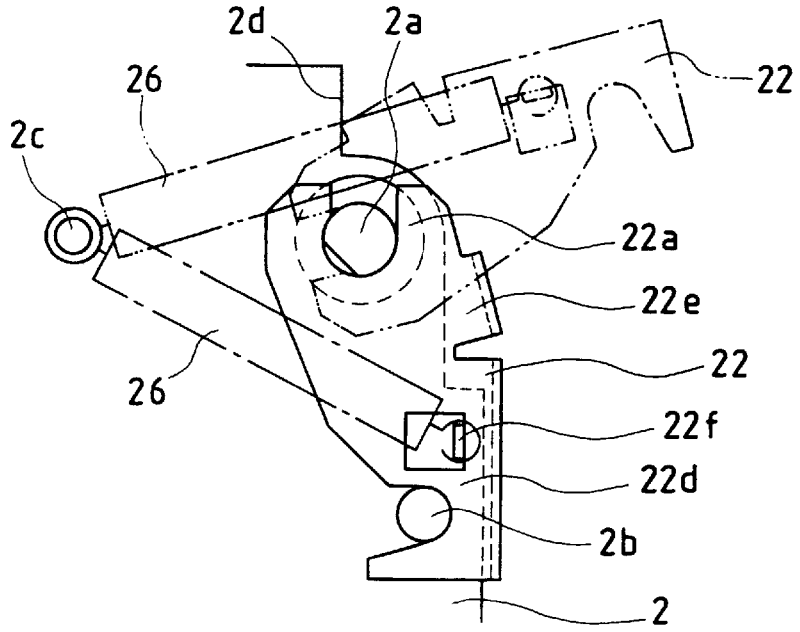
FIG. 5 is a view taken in the direction of the arrows along the line V—V of FIG. 3.
Figure 6:
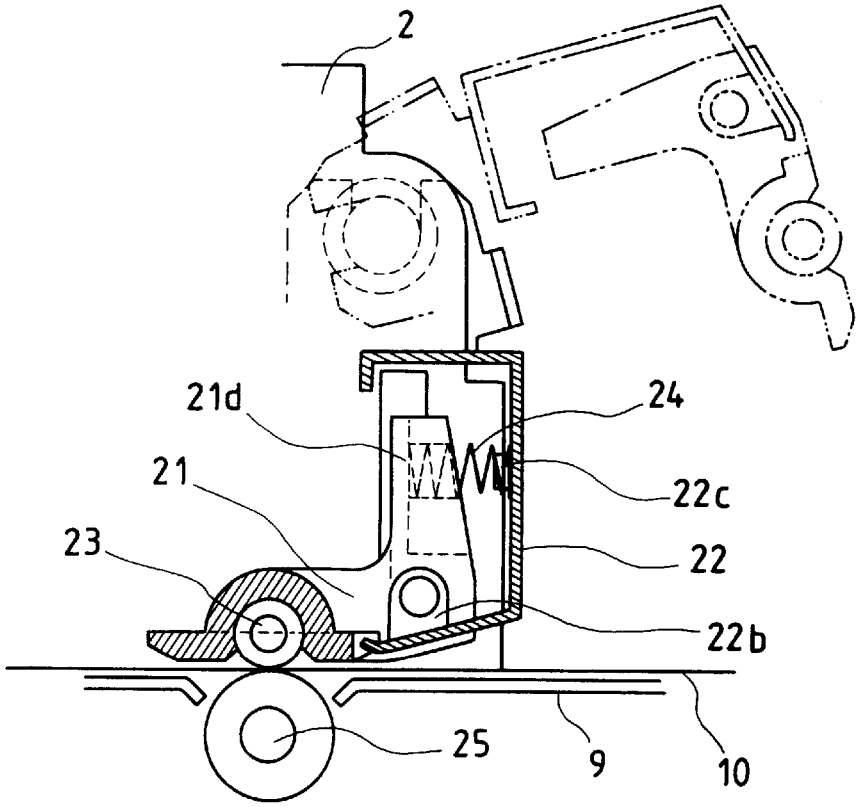
FIG. 6 is a sectional view taken along the line VI—VI of FIG. 3.

As clearly shown in FIGS. 5 and 6, a positioning portion 2*d* is formed at the outer peripheral portion of the side frame 2, and on the other hand the rocking frame 22 is provided with a stopper 22*e* which abuts on the positioning portion 2*d*.

Also, as shown in FIG. 5, a spring fixing portion 2*c* is provided on the outside of the side frame 2 to fix one end of a rocking spring 26, and a spring fixing portion 22*f* is provided on the rocking frame 22 to fix the other end of the rocking spring 26, so that the rocking spring 26 is extendedly mounted between the spring fixing portion 2*c* and the spring fixing portion 22*f*.

In a state of paper feed indicated by the thick line in FIG. 5, the rocking spring 26 urges in a direction such that the positioning portion 22*d* of the rocking frame 22 is pressed on the positioning pin 2*d* provided on the side frame 2, so that the rocking spring 26 functions so that the position of the rocking frame 22 is stabilized.

Also, in a state in which the rocking frame 22 is rocked to a position indicated by the thin line in FIG. 5, the rocking frame 22 is positioned by the stopper 22*e* of the rocking frame 22 so as to abutt on the positioning portion 2*d* of the side frame 2, so that the rocking frame 22 does not return to the downside and the transfer path 12 is kept open. Thereby, the work for removing a jamming printing paper, for removing the printing head 6 from the carriage 6, for attaching/detaching an ink ribbon (not shown), and other work are made very easy.

FIG. 6 shows a state in which the pressing roller 23 of the first paper guide (roller holding member) 21 is pressed on the paper feed roller 25. In this state, one end of the pressing spring 24 is fixed to the spring fixing portion 22*c* of the rocking frame 22, and the other end of the pressing spring 24 is pressed on the spring fixing portion 21*d* of the first paper guide. Therefore, the first paper guide 21 is given an urging force for rocking the first paper guide 21 in the direction of the paper feed roller 25. At this time, the rocking frame 22 is positioned by the rocking engagement portion 2*a* and the positioning pin 2*d* provided on the side frame 2. The pressing roller 23 is positioned on the paper feed roller 25, and the pressing force of the pressing spring 24 functions as a pressing force to the paper feed roller 25.

The following is a description of a pressing force switching mechanism for the pressing roller, paper course switching mechanism, and tractor driving force transmission mechanism.

First, the pressing force switching mechanism for the pressing roller will be described with reference to FIGS. 7 to 10.

The support frame 32 transversely mounted to the side frames 2*a* and 2*b* is so constructed that the guide support portion 32*a* pivotally supports a guide shaft 31*d* of the second paper guide (roller holding member) 31 so as to be rotatable.

At one end of the second paper guide (roller holding member) 31, a roller support portion 31*e* pivotally supports the pressing roller 33 so as to be rotatable. At the other end thereof, the spring fixing portion 31*c* fixes one end of the pressing spring 34. Further, at the central portion, a rocking shaft 36*a* of the rocking member 36 is pivotally supported so as to be rotatable.

For the rocking member 36, a spring fixing portion 36*b* provided at the tip end fixes the other end of the pressing spring 34. Therefore, the pressing spring 34 is extendedly mounted between the spring fixing portion 31*c* of the second paper guide 31 and the spring fixing portion of the rocking member 36.

On the other hand, for the switching cam shaft 38 transversely mounted to the side frames 2 so as to be rotatably, the switching cam 37 is fixed at a position corresponding to the rocking member 36, so that the switching cam shaft 38 rotates integrally with the switching cam 37. Also, the tip end portion 37*a* of the switching cam 37 abuts on the rocking member 36.

The paper feed roller 35 is pivotally supported on the side frames 2 rotatably so as to be opposed to the pressing roller 33. When the paper feed roller 35 is rotated by a rotation driving device (not shown), the pressing roller 33 is rotated in a slave manner. The paper feed roller 35 and the pressing roller 33 holds the printing paper 10 therebetween, so that the printing paper 10 is fed by the rotation of the paper feed roller 35.

Figure 7:
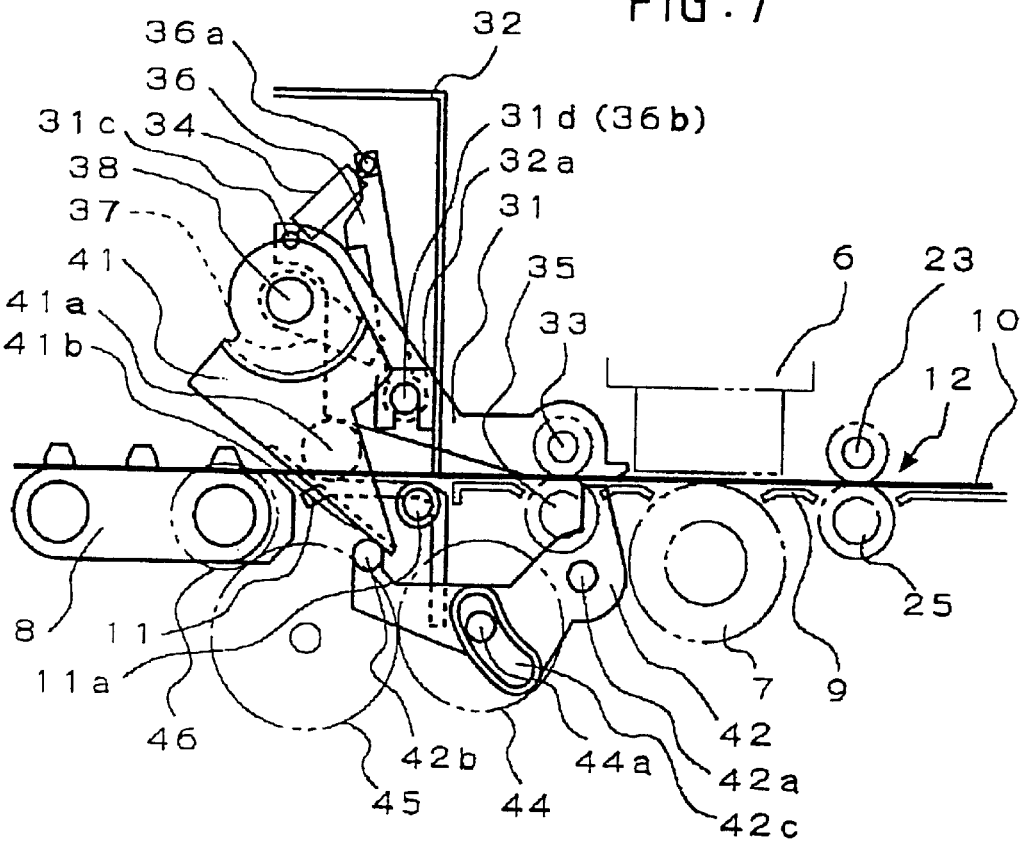
FIG. 7 is a sectional view of a principal portion of a paper feed device for a printer in a continuous paper printing mode in accordance with the present invention.
Figure 9:
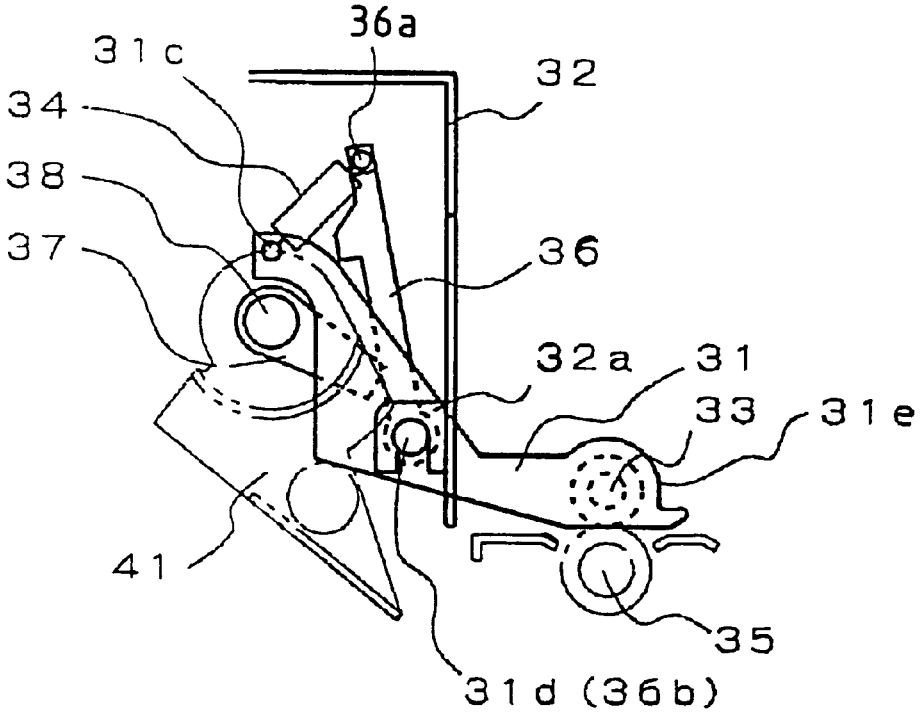
FIG. 9 is a sectional view mainly showing a pressing force switching mechanism for a pressing roller in FIG. 7.

In a continuous paper printing mode shown in FIGS. 7 and 9, the tip end portion 37*a* of the rocking cam 37 is positioned at the lower part of the rocking member 36, and the spring fixing portion 36*a* of the rocking member 36 is close to the second paper guide 31*c*. At this time, a pulling force created on the pressing spring 34 is decreased, so that the pressing force of the pressing roller 33 on the paper feed roller 35 is also decreased.

In a continuous paper printing mode, the printing paper (continuous paper) 10 is delivered from the tractor 8, and fed to the printing head 6 by means of the pressing rollers 33 and the paper feed rollers 35. In this state, if the pressing force of the pressing roller 33 is strong, paper feed of the tractor 8 and that of the paper feed roller 35 conflict with each other, resulting in jamming of paper. In a continuous paper printing mode, therefore, by decreasing the pressing force of the pressing roller 33, the conflict between the paper feed roller 35 and the tractor 8 is avoided, by which the jamming of the printing paper (continuous paper) 10 can be prevented.

Figure 8:
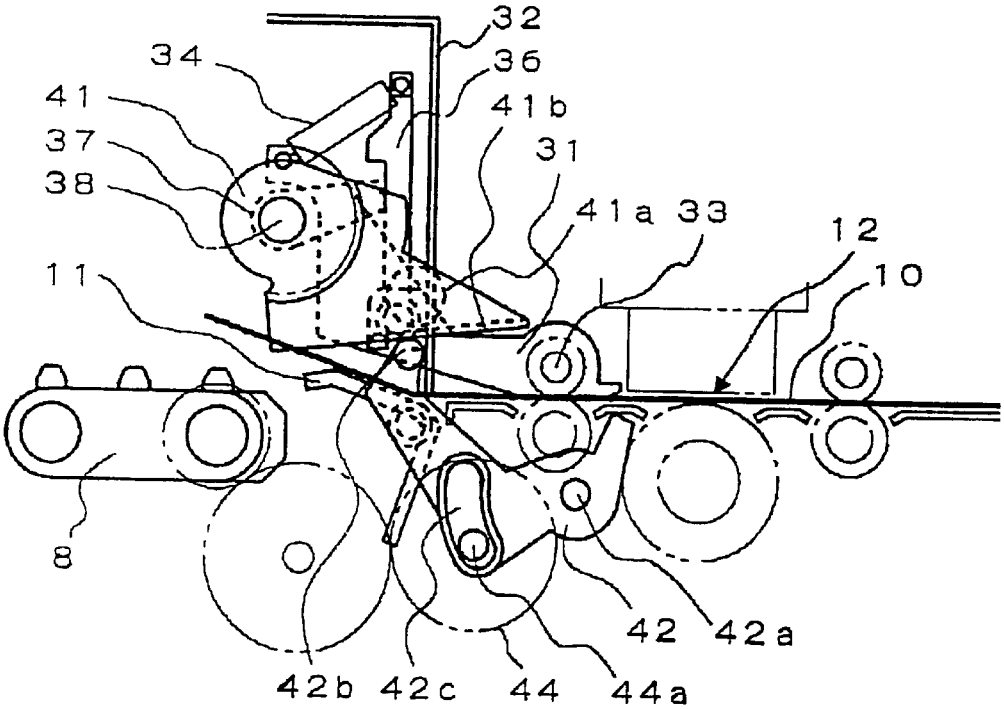
FIG. 8 is a sectional view of a principal portion of a paper feed device for a printer in a cut paper printing mode in accordance with the present invention.
Figure 10:
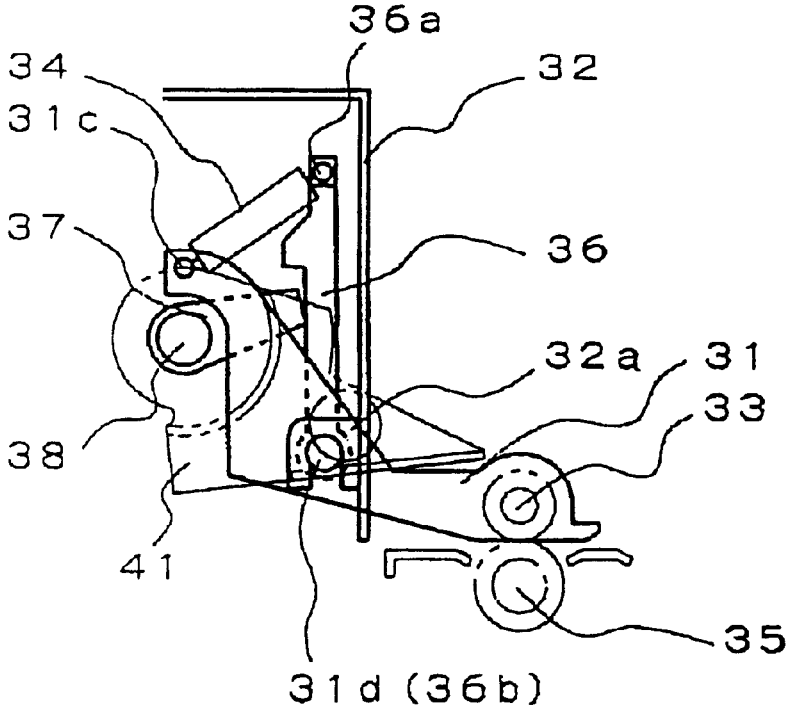
FIG. 10 is a sectional view mainly showing a pressing force switching mechanism for a pressing roller in FIG. 8.

In a cut paper printing mode shown in FIGS. 8 and 10, the tip end portion 37*a* of the rocking cam 37 is positioned at the upper part of the rocking member 36, and the spring fixing portion 36*a* of the rocking member 36 is away from the spring fixing portion 31*c* of the second paper guide 31. Therefore, a pulling force created on the pressing spring 34 is increased as compared with the continuous paper printing mode, so that the pressing force of the pressing roller 33 on the paper feed roller 35 is increased.

In a cut paper printing mode, since the tractor 8 is not used, the cause of the conflict between the tractor 8 and the paper feed roller 35 and the resulting jamming of the printing paper (cut paper) 10 is eliminated. In a cut paper printing mode, therefore, by increasing the pressing force of the pressing roller 33, the printing paper (cut paper) can be fed securely.

As described above, by combining the second paper guide 31, which is used as both of the paper guide and the holding member for the pressing roller 33, the rocking member 36, the switching cam 37, and the pressing spring 34, the switching mechanism of pressing force of the pressing roller 33 on the paper feed roller 35 can be configured in a compact form in accordance with the printing mode.

In particular, by decreasing the distance from the pressing roller 33 to the switching cam shaft 38, the depth of printer can be decreased.

Next, the paper course switching mechanism in continuous paper and cut paper printing modes will be described with reference to FIGS. 7, 8, 11 and 12.

A rocking plate 41 is fixed to the shaft end portion of the switching cam shaft 38, and rocks integrally with the switching cam shaft 38. The rocking plate 41 has a switching pin 41*a* for rocking the switching plate.

For the switching plate 11, the plate shaft is transversely mounted to the side frames 2 so as to be rotatable. The switching plate 11 has a printing paper transfer surface formed on the upper surface of the switching plate and a spring fixing portion 11*c* provided at the lower end thereof.

A stopper pin 11*b* installed on the side frame 2 is provided to regulate the upward rocking motion of the switching plate 11.

For a rocking spring 47, one end thereof is fixed to the side frame 2 and the other end thereof is fixed to the spring fixing portion 11*c* of the switching plate 11.

Figure 11:
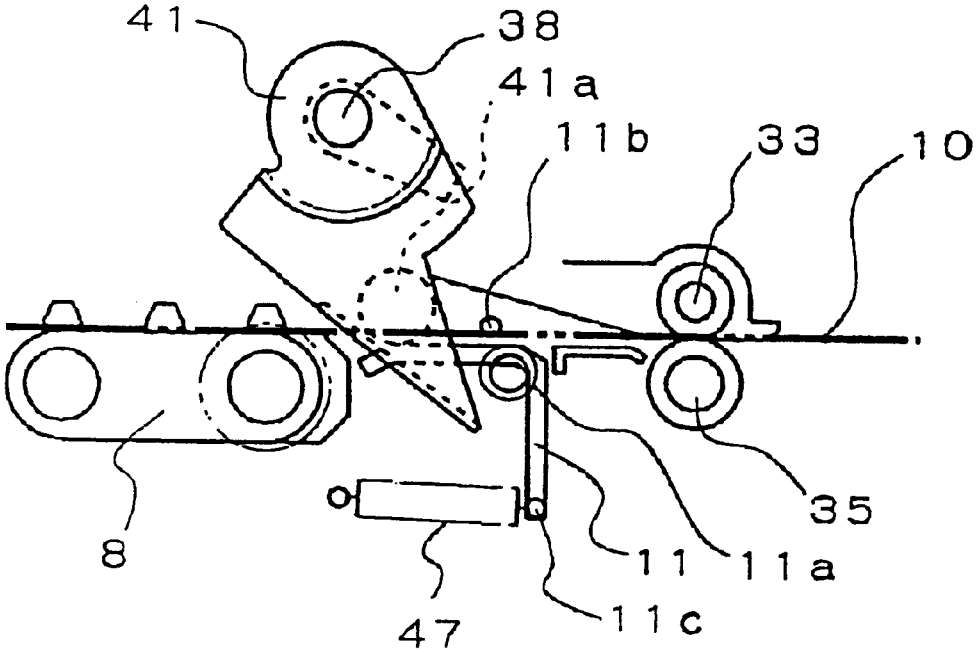
FIG. 11 is a sectional view mainly showing a paper course switching mechanism in FIG. 7.

In a continuous paper printing mode shown in FIGS. 7 and 11, the rocking plate 41 pushes down the switching plate 11 against the urging force of the rocking spring 47 by means of the switching pin 41*a*.

The switching plate 11 pushed down by the switching pin 41*a* has the transfer surface formed substantially flush with the tractor 8. Therefore, the printing paper 10 (continuous paper) delivered from the tractor 8 goes through over the switching plate 11 and is fed in the printing head direction.

Figure 12:
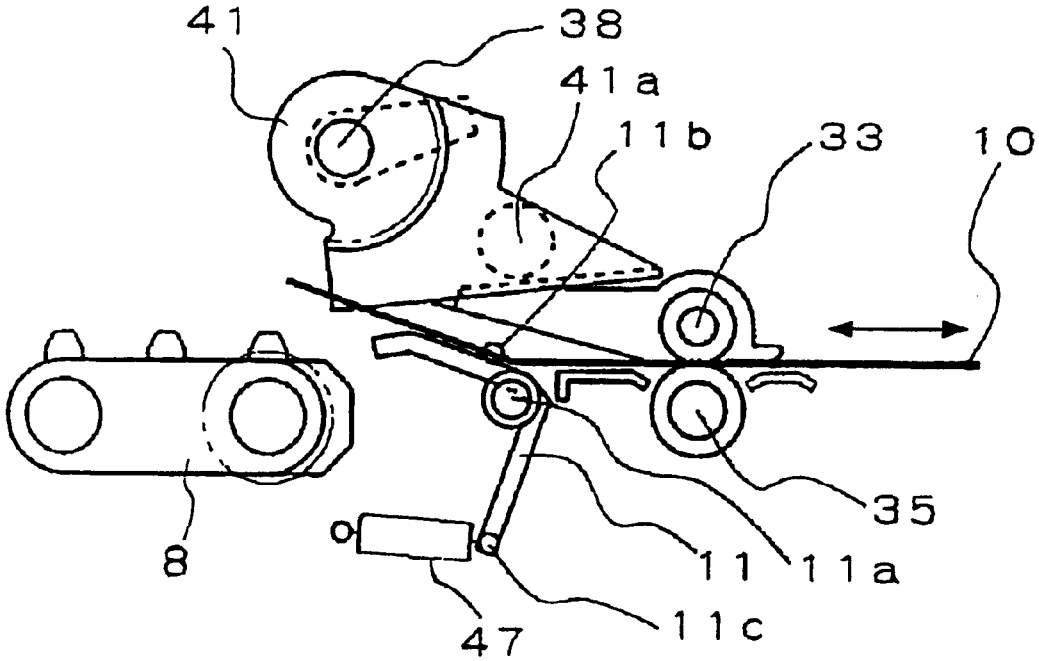
FIG. 12 is a sectional view mainly showing a paper course switching mechanism in FIG. 8.

In a cut paper printing mode shown in FIGS. 8 and 12, the switching pin 41*a* of the rocking plate 41 is away from the switching plate 11. At this time, since the spring fixing portion 11*c* of the switching plate 11 is pulled by the rocking spring 47, the switching plate 11 is rocked around a plate shaft 11*a*, and positioned at a predetermined angle by the stopper pin 11*b*.

At this time, since the switching plate 11 is positioned in an inclined manner, the printing paper (cut paper) 10 is fed obliquely upward along the switching plate 11, so that the contact with the tractor 8 is avoided.

As described above, the switching of paper course can be performed in accordance with the printing mode by a simple configuration of the rocking plate 41, switching plate 11, and rocking spring 47.

Next, the tractor drive transmission mechanism will be described with reference to FIGS. 7, 8, 13*a*, 13*b*, 14*a* and 14*b*.

The rocking plate 41 has a switching portion 41*b* for rocking a tractor switching lever 42.

The tractor switching lever 42 pivotally supported on a switching lever shaft 42*a*, which is mounted to the side frames 2, so as to be rockable has an abutting portion 42*b* abutting on the switching portion 41*b* of the rocking plate 41, positioned at one end thereof, a spring fixing portion 42*d* for fixing a lever spring 43, positioned on the other end thereof, a guide hole through which a drive gear shaft 44*a* of the third transmission gear 44, and a gear positioning portion 42*e* provided on the lower face of guide hole.

For the lever spring 43, one end thereof is fixed to the side frames 2, and the other end thereof is fixed to the spring fixing portion 42*d* of the tractor switching lever.

The third transmission gear 44 pivotally supported rotatably on the drive gear shaft 44*a* erected on the side frame 2 is urged along the axial direction of the drive gear shaft 44*a* by a drive gear spring 44*b*, and is positioned in the axial direction by the gear positioning portion 42*e* of the tractor switching lever 42.

The fourth transmission gear 45 pivotally supported rotatably on the side frames 2 meshes with the third transmission gear 44 depending on the position of the third transmission gear 44.

The tractor drive gear 46 meshes with the fourth transmission gear 45 and is also connected directly to the tractor 8 to operate the tractor 8.

In a continuous paper printing mode shown in FIGS. 11, 13*a* and 13*b*, the abutting portion 42*b* of the tractor switching lever 42 is pushed down by the switching portion 41*b* of the rocking plate 41. At this time, the tractor switching lever 42 is positioned so that the drive gear shaft 44*a* is located at an upper part of the guide hole 42*c*.

Since at a sliding face 42*e* at the upper part of the guide hole 42, the thickness of the tractor switching lever 42 is increased, the third transmission gear 44 is shifted toward the side frame 2. At this time, the third transmission gear 44 meshes with the fourth transmission gear 45, so that the rotation of the third transmission gear 44 is transmitted to the tractor via the fourth transmission gear 45 and the tractor drive gear 46.

In a cut paper printing mode shown in FIGS. 8, 14*a* and 14*b*, the abutting portion 42*b* of the tractor switching lever 42 is rocked upward by the lever spring 43 in connection with the upward rocking motion of the switching portion 41*b* of the rocking plate 41.

The tractor switching lever 42 is positioned so that the drive gear shaft 44*a* is located at a lower part of the guide hole 42*c*.

Since at the sliding face 42*e* at the lower part of the guide hole 42, the thickness of the tractor switching lever 42 is decreased, the third transmission gear 44 is shifted in the direction reverse to the side frame 2. At this time, the third transmission gear 44 is disengaged from the fourth transmission gear 45, so that the rotation of the third transmission gear 44 is not transmitted to the tractor.

As described above, the tractor drive transmission mechanism can be provided in a simple configuration by the rocking plate 41, tractor switching lever 42, lover spring 43, third transmission gear 44 and the drive gear spring 44*b*.

As described above, the paper feeding device is made up of the pressing force switching mechanism for switching the pressing force of the pressing roller 33 on the paper feed roller according to the continuous paper and cut paper printing modes, the paper course switching mechanism for switching the paper course of the printing paper 10, and the tractor drive transmission mechanism for releasing the transmission of rotating operation of the tractor 8.

By rocking the switching cam shaft 38 and the rocking plate 41 fixed to the shaft end portion of the switching cam shaft, the pressing force switching mechanism, paper course switching mechanism, and tractor drive transmission mechanism can be operated collectively.

A drive gear portion 41*c* provided on the rocking plate 41 can be operated by a drive unit (not shown) by engaging with the gear of the drive unit which is provided separately.

Figure 15:
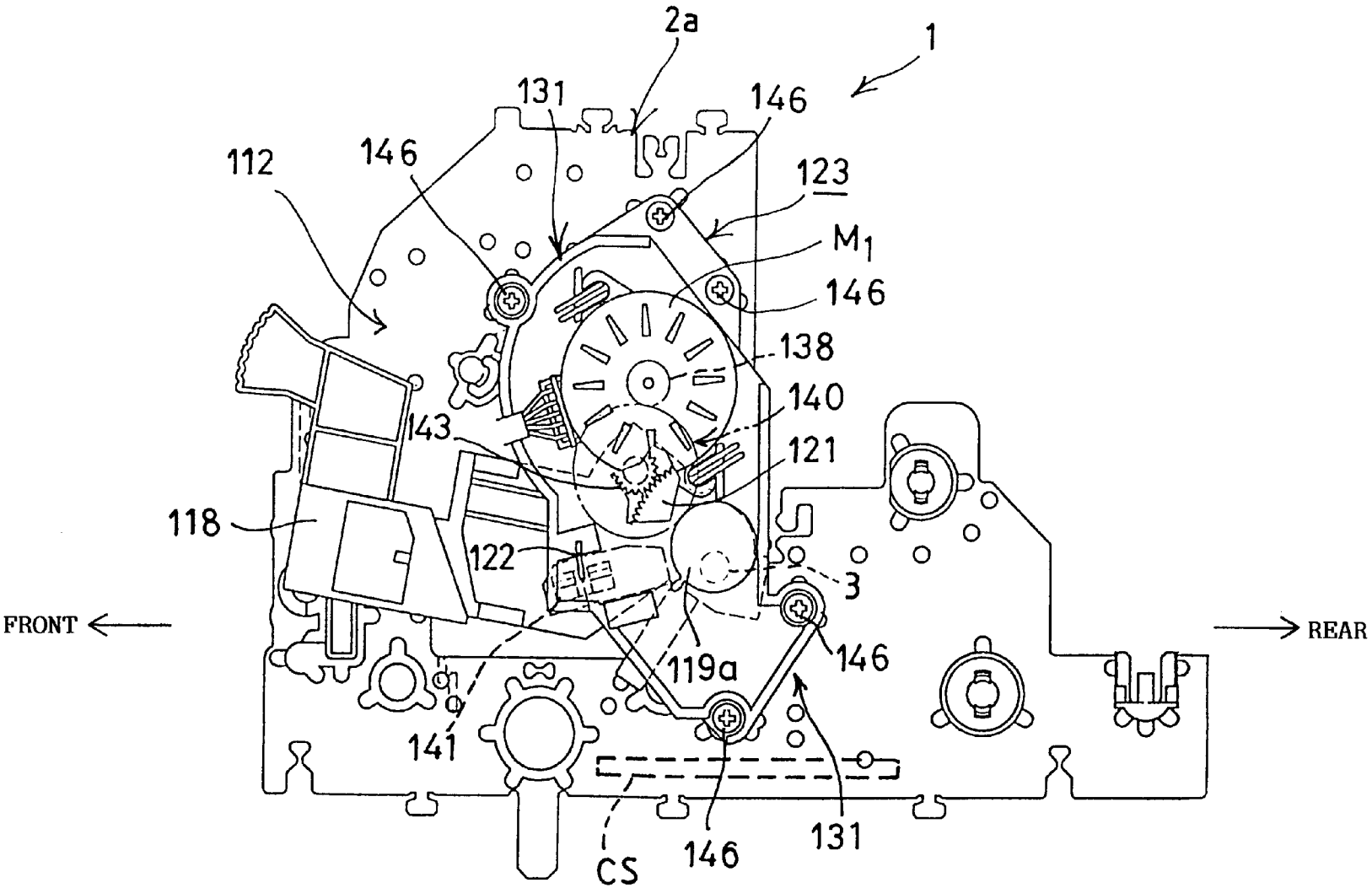
FIG. 15 is a right side view of a printer.
Figure 16:
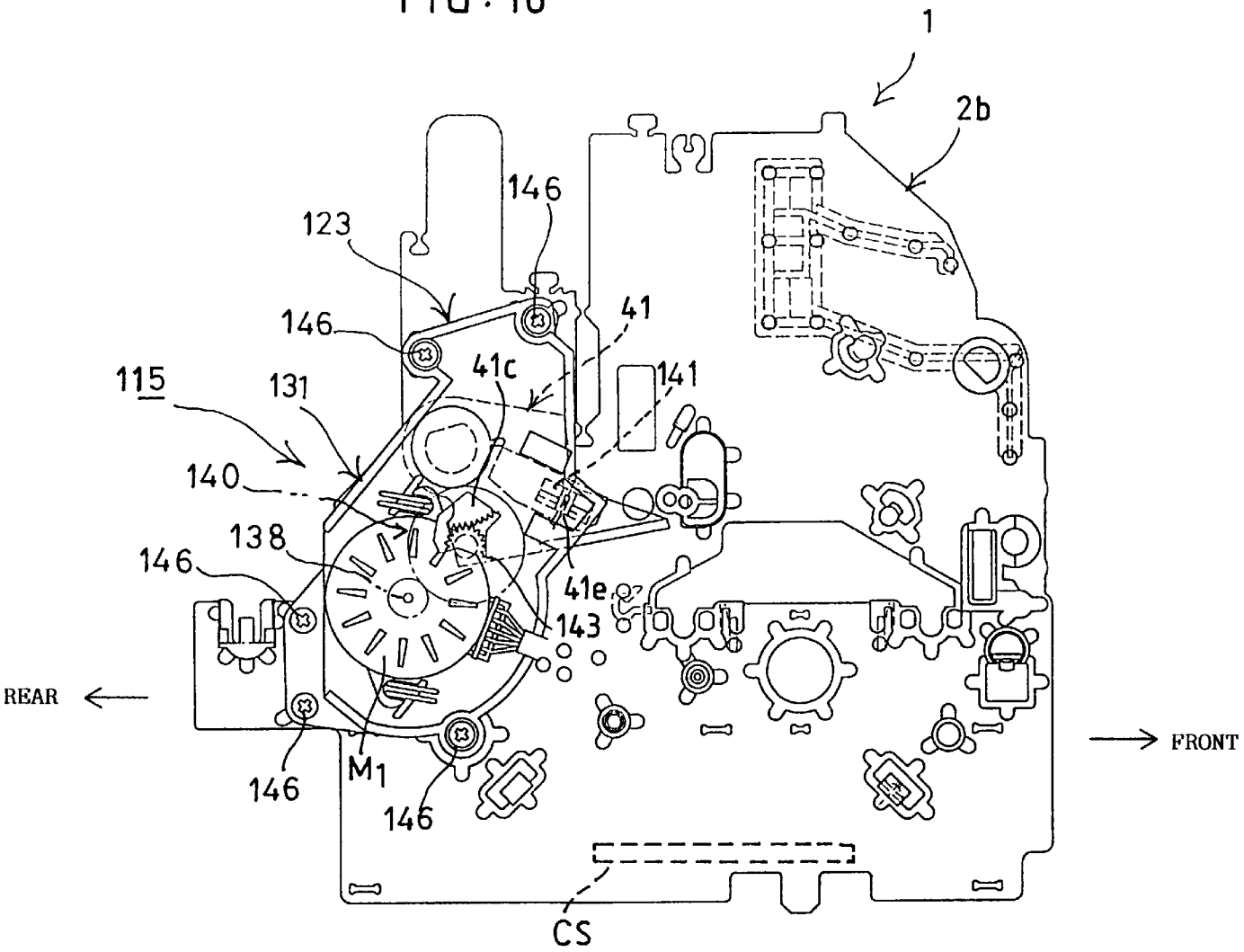
FIG. 16 is a left side view of a printer 1.
Figure 17:
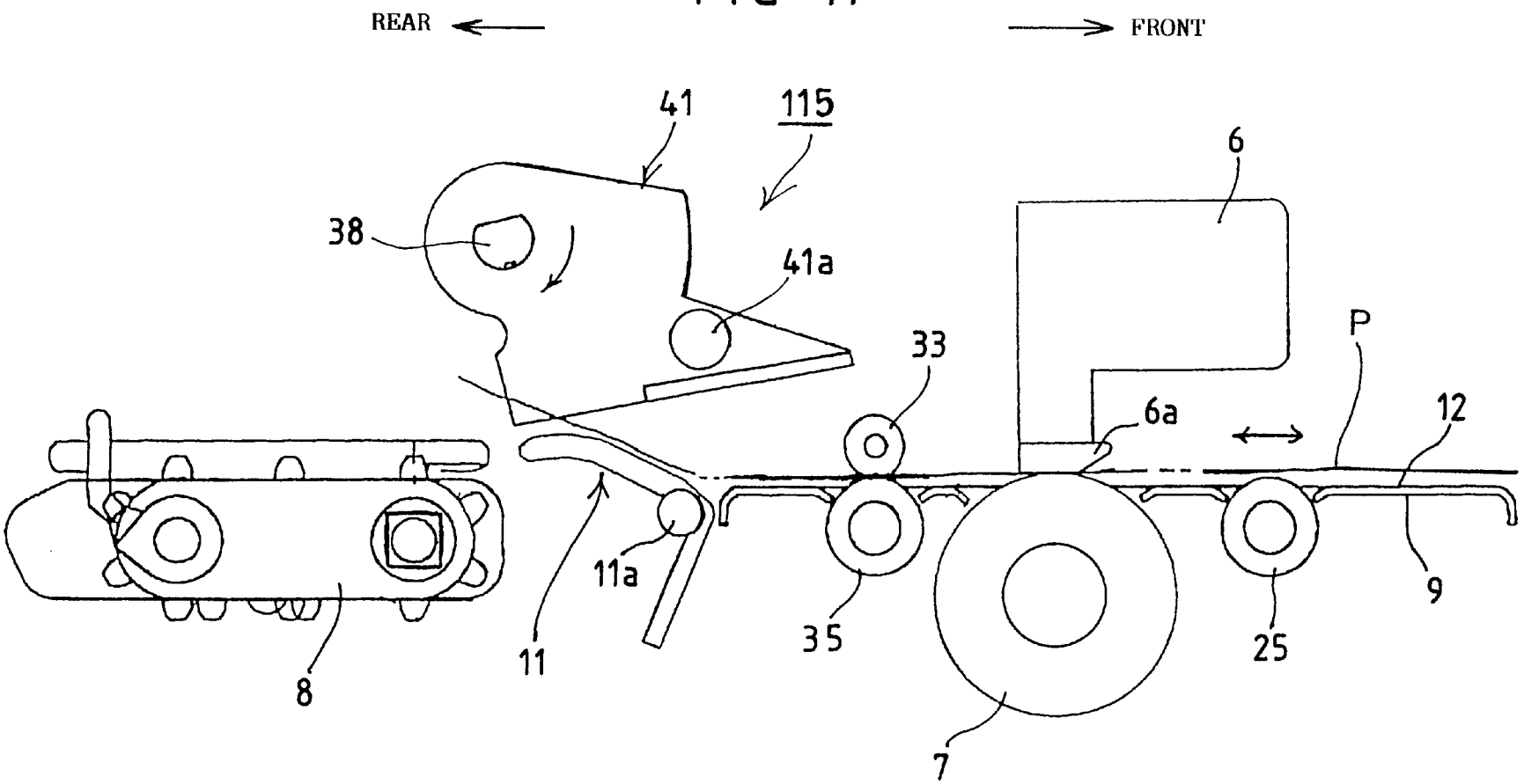
FIG. 17 is a schematic view of a principal portion of a paper course for a cut paper.

As shown in FIGS. 15 to 17, the type printer 1 has the right side frame 2*a* and the left side frame 2*b*, and also is provided with the substantially horizontal transfer plate 9 extending from the lower part of the left side frame 2*b* to the lower part of the right side frame 2*a*, so that the flat transfer path 12 for paper is formed on the upper surface of the transfer plate 9.

As shown in FIG. 17, under the central portion of the transfer plate 9 is provided the platen 7 extending in the transverse direction of the printer 1, which is arranged so that the upper part of the peripheral surface thereof is exposed above the transfer path 12. Also, the paper feed rollers 25 and 35 extending in the transverse direction of the printer are provided on longitudinal opposite sides of the platen 7. The upper part of the peripheral surface of the paper feed rollers 25 and 35 each is exposed above the transfer path 12. Further, the pressing roller 33 is provided which is pressed from the upside on the paper feed roller 35 arranged on the rear side of the platen 7.

Above the platen 7, the printing head 6 is provided so that a head portion (printing portion) 11 for performing printing faces the platen 7 arranged under the head portion 11. Between the platen 7 and the tip end of the head portion 11 is formed a gap which is controlled according to the thickness of a paper P to be printed. This gap is controlled by a gap control mechanism 112 disposed on the outside surface of the right side frame 2*a* as shown in FIG. 15. The printing head 6 is mounted on the carriage. The carriage is fitted slidably to the carriage shaft 3 transversely mounted between the right and left side frames 2 and 3.

In FIG. 17, the tractor 4 for delivering a continuous paper toward the printing head 6 is disposed on the rear side of the transfer plate 9, and the paper course switching mechanism 115 for switching between the paper course for continuous paper and the paper course for cut paper is provided between the rear end of the transfer plate 9 and the tractor 4. The paper course switching mechanism 115 is made up of the switching plate 11 which is rockably disposed between the rear end of the transfer plate 9 and the tractor 4 and a rocking plate 41 which is provided rockably on the outside surface of the left side frame 2*b* shown in FIG. 16 to switch the paper course by switching the rocked posture between the inclined posture and the horizontal posture by abutting on the switching plate 11.

Figure 18:
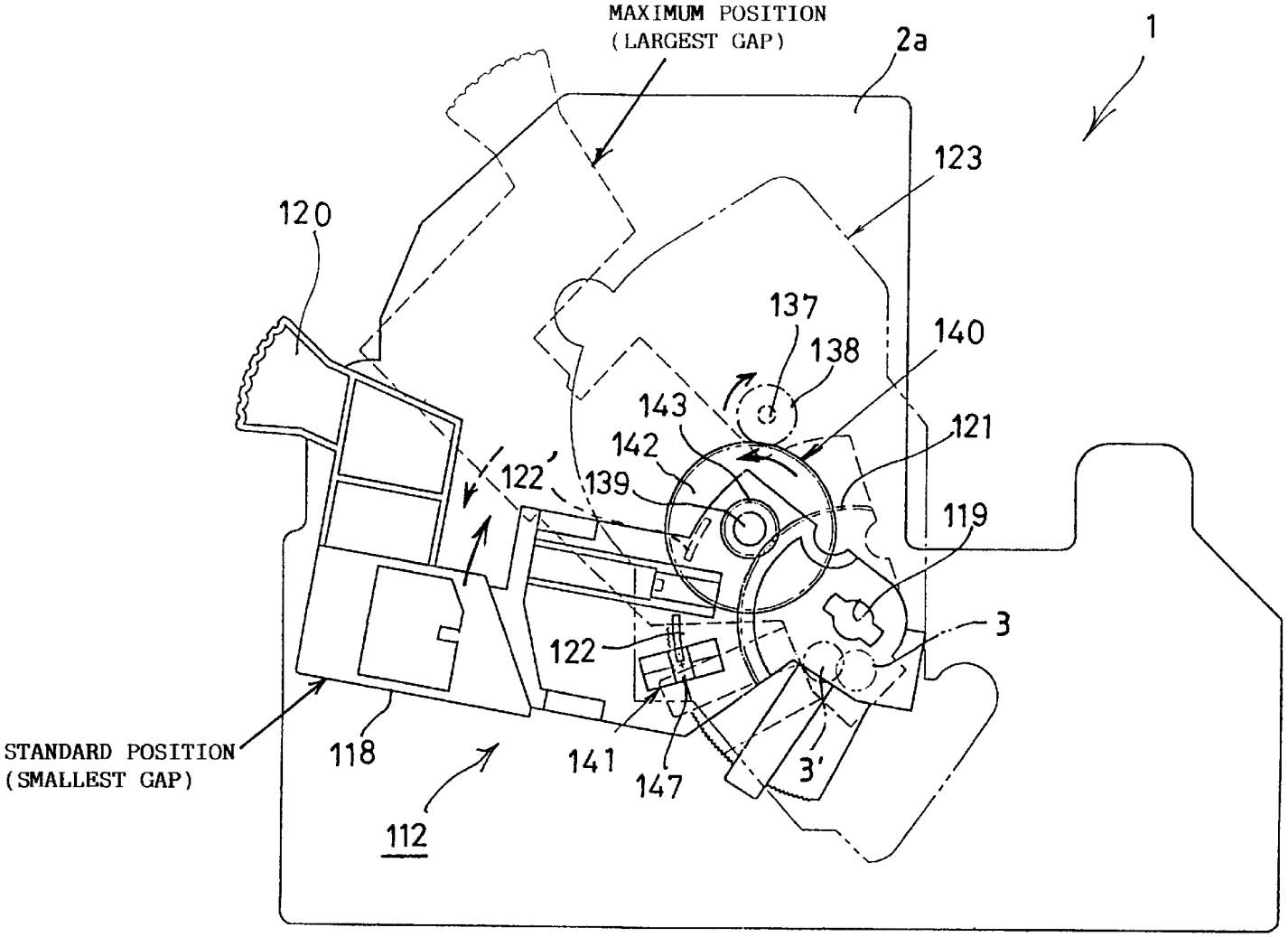
FIG. 18 is a side view for illustrating a gap control mechanism disposed on the outside surface of a right side frame.

FIG. 18 is a side view for illustrating the gap control mechanism 112 disposed on the outside surface of the right side frame 2*a*. The gap control mechanism 112 has a gap control lever 118 pivotally supported on the outside surface of the right side frame 2*a* so as to be rockable. The gap control lever 118 is formed with an irregularly shaped fitting hole 119 on the base end side, which is the center of rocking motion, and is provided with a finger-putting portion 120 operated at the time of manual operation on the tip end side. Near the base end on the outside surface, a sector gear portion 121 spreading concentrically from the center of rocking motion is formed integrally, and a protrusion-shaped sensor portion 122 is provided on the outside of the sector gear portion 121 from the center of rocking motion.

One end of a rotating element 19*a* (FIG. 15), which is rotatably supported at fixed positions of the right and left side frames 2 and 3, is fitted in the fitting hole 119 formed on the base end side of the gap control lever 118, and the gap control lever 118 is rockably supported along the outside surface of the right side frame 2*a* integrally with the rotating element 19*a*.

The carriage shaft 3 is supported so that the support portions at both ends are fitted at eccentric positions of the right and left rotating element 19*a*.

In FIG. 18, the position and posture of the gap control lever 118 indicated by the solid line represent the standard position where the gap is at a minimum, while the position and posture indicated by the broken line represent the maximum position for thick paper where the gap is at the maximum.

The gap control lever 118 can be stopped at any rocking position in the range of the standard position to the maximum position by a click stop mechanism, and the standard position and the maximum position are regulated by two stoppers.

When the gap control lever 118 is rocked by operating the finger-putting portion 120 manually, the rotating element 19*a* provided on the right side frame 2*a* is rotated integrally with the gap control lever 118, by which the carriage can be moved in the direction such as to come close to and go away from the platen 7 in the range of distance corresponding to the eccentric dimension with respect to the axis of the carriage shaft 3. Thereby, the gap formed between the printing head 6 mounted on the carriage and the platen 7 can be controlled in accordance with the thickness of paper to be fed.

Figure 19:
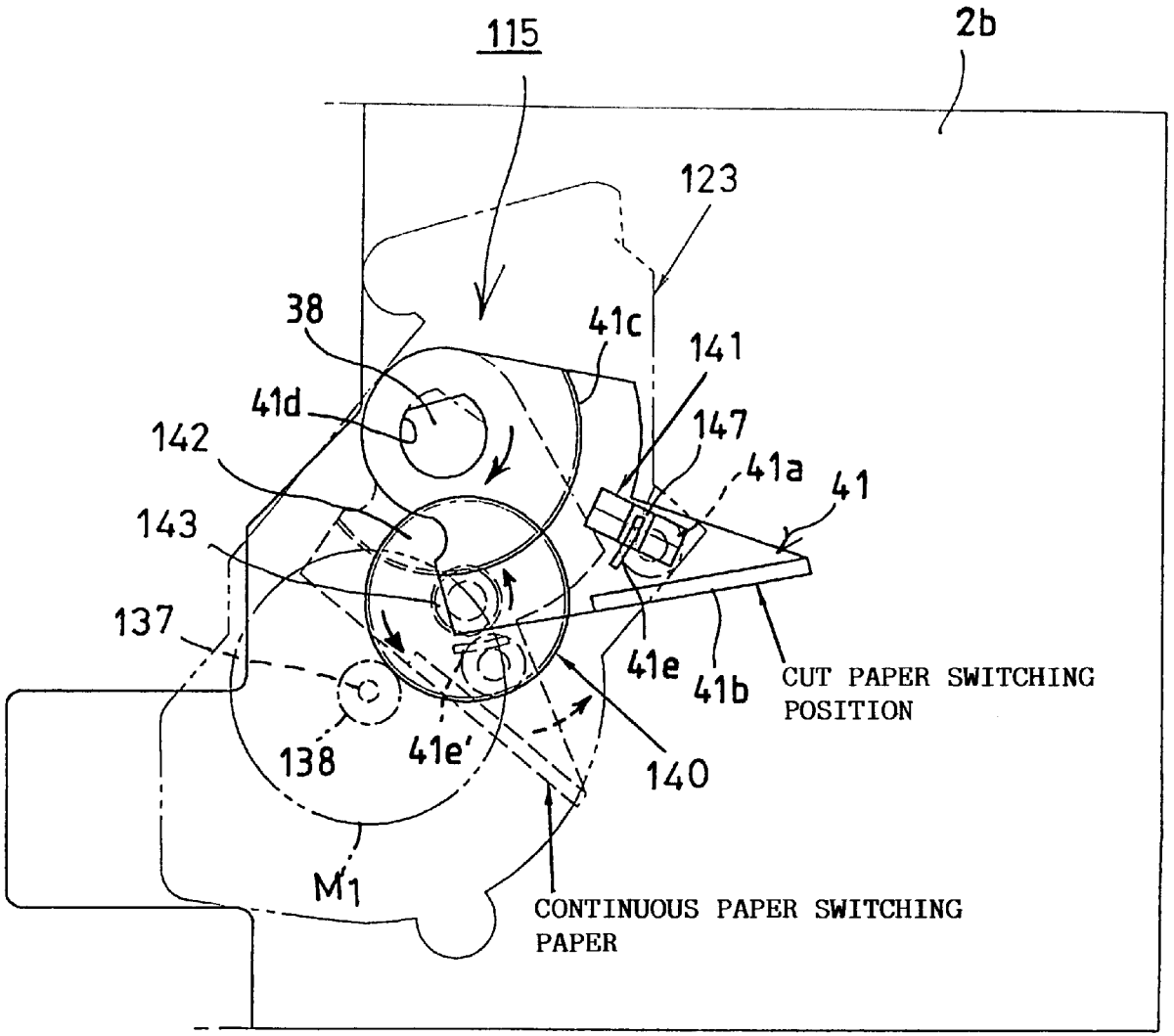
FIG. 19 is a side view of a switching lever for a paper course switching mechanism disposed on the outside surface of a left side frame.
Figure 20:
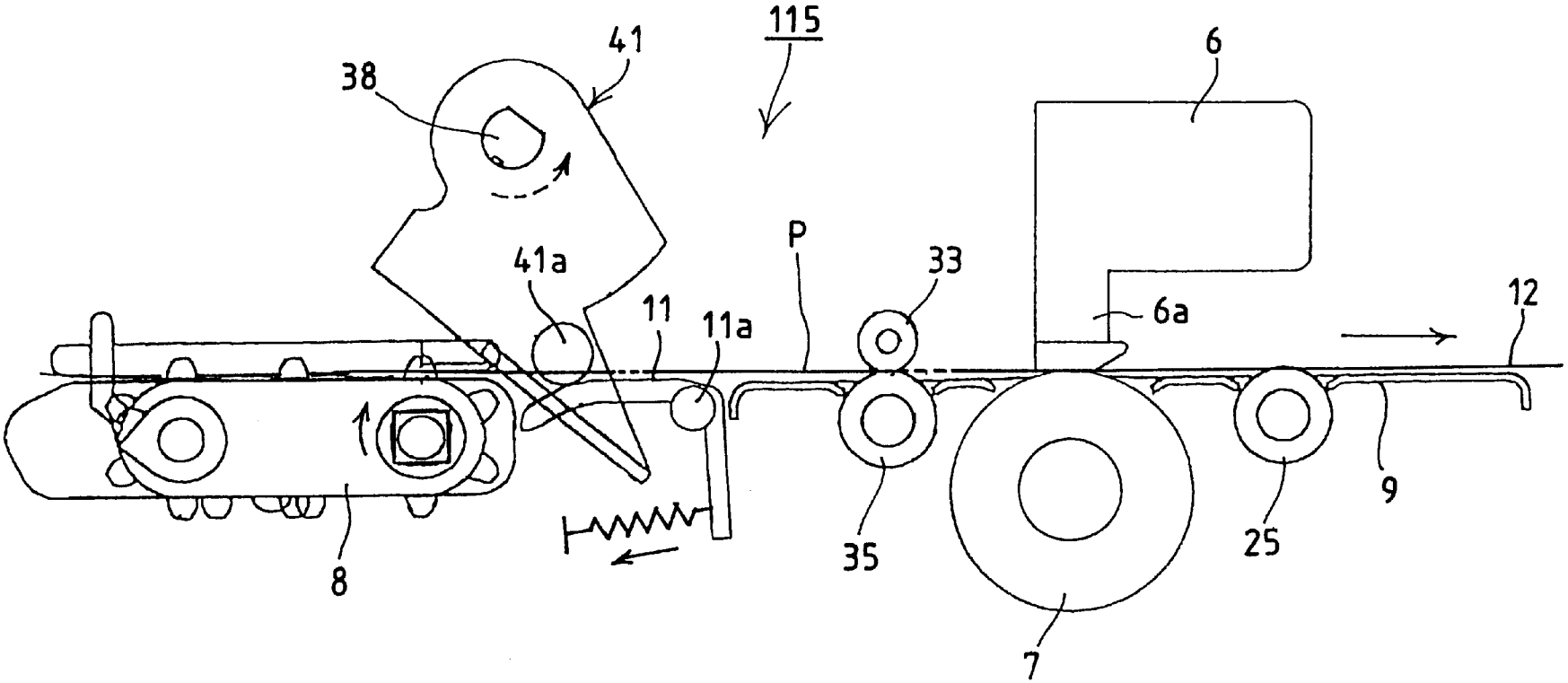
FIG. 20 is a schematic view of a principal portion of a paper course for a continuous paper.

FIG. 19 is a side view of a principal portion of the rocking plate 41 for the paper course switching mechanism 115 disposed on the outside surface of the left side frame 2*b*. FIG. 20 is a schematic side view showing the paper course for a continuous paper.

As shown in FIG. 19, the rocking plate 41 is formed with an irregularly shaped fitting hole 24 at the base end side, which is the center of rocking motion, and is provided with a finger-putting portion 25 operated at the time of manual operation on the tip end side. Near the base end on the outside surface of the rocking plate 41, a sector gear portion 26 spreading concentrically from the center of rocking motion is formed integrally, and a protrusion-shaped sensor portion 27' is provided on the outside of the sector gear portion 26 from the center of rocking motion. Also, near the tip end on the inside surface of the rocking plate 41, a column-shaped protrusion 28 is provided.

The tip end of the switching cam shaft 38, which is rotatably supported at fixed position on the outer surface of the left side frame 2*b*, is fitted in the fitting hole 24 formed on the base end side of the rocking plate 41, and the rocking plate 41 is rockably supported along the outside surface of the left side frame 3 integrally with the switching cam shaft 38. Also, the column-shaped protrusion 28 is provided on the inside surface of the rocking plate 41, and the tip end side thereof projects to the inside of the left side frame 2*b* through an arcuate hole formed in the right side frame 2*a*.

Also, in FIG. 20, the switching plate 11 is long in the transverse direction, and the plate shaft 11*a* provided transversely is pivotally supported on the inside surface of the right and left side frames 2 and 3, and is urged clockwise in the figure by an urging spring.

The position and posture of the rocking plate 41 indicated by the solid line in FIG. 19 represent a state in which the paper course switching mechanism 115 is switched to the cut paper course. In this state, the column-shaped protrusion 28 of the rocking plate 41 separates from the top surface of the switching plate 11, and the tip end side of the switching plate 11 is pulled up by the urging spring and faces obliquely upward. This position of the rocking plate 41 is the cut paper switching position.

The position and posture indicated by the chain line represent a state in which the paper course switching mechanism 115 is switched to the continuous paper course. In this state, the column-shaped protrusion 28 of the rocking plate 41 pushes down the top surface of the switching plate 11 against the urging force of the urging spring, so that the top surface of the switching plate 11 is substantially horizontal (FIG. 20). This position of the rocking plate 41 is the continuous paper switching position.

By manually turning the finger-putting portion 25 of the rocking plate 41, the switching plate 11 is tilted, by which the paper course can be switched manually between the cut paper course and the continuous paper course. The cut paper and continuous paper switching positions are regulated by stoppers.

The gap can be controlled by rocking the gap control lever 118 by manual operation. When the gap control lever 118 is rocked electrically, however, as shown in FIGS. 15 and 18, a power unit 123, described later, is installed at a predetermined position on the outside surface side of the gap control lever 118 on the right side frame 2*a*.

Also, when the rocking plate 41 is rocked electrically, the power unit 123 is installed at a predetermined position on the outside surface of the rocking plate 41 on the right side frame 2*a* as shown in FIGS. 16 and 19. In FIGS. 15 and 16, reference character CS denotes a printer control section, which controls the operation of the gap control mechanism 112 and also the paper course switching mechanism.

Figure 21:
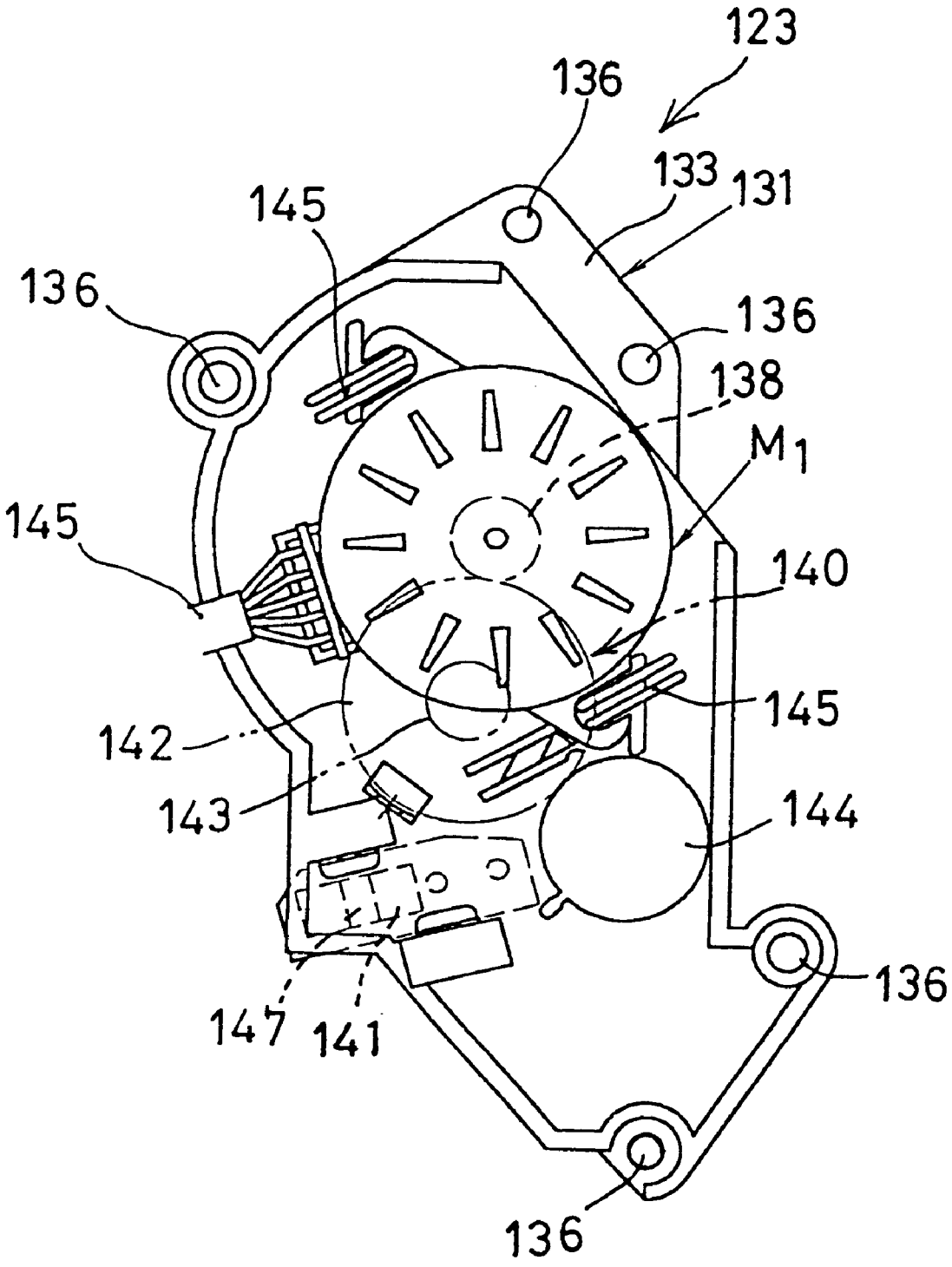
FIG. 21 is a front view of a power unit (normal posture)
Figure 22:
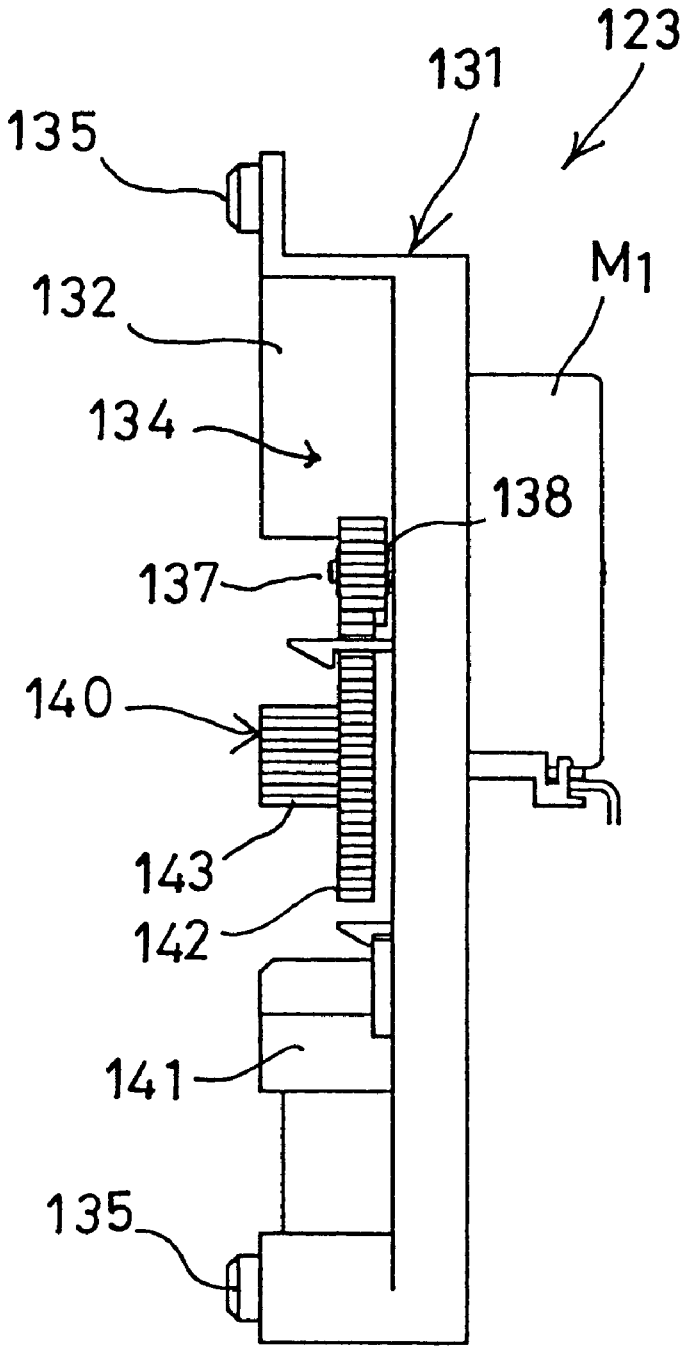
FIG. 22 is a side view of a power unit.
Figure 23:
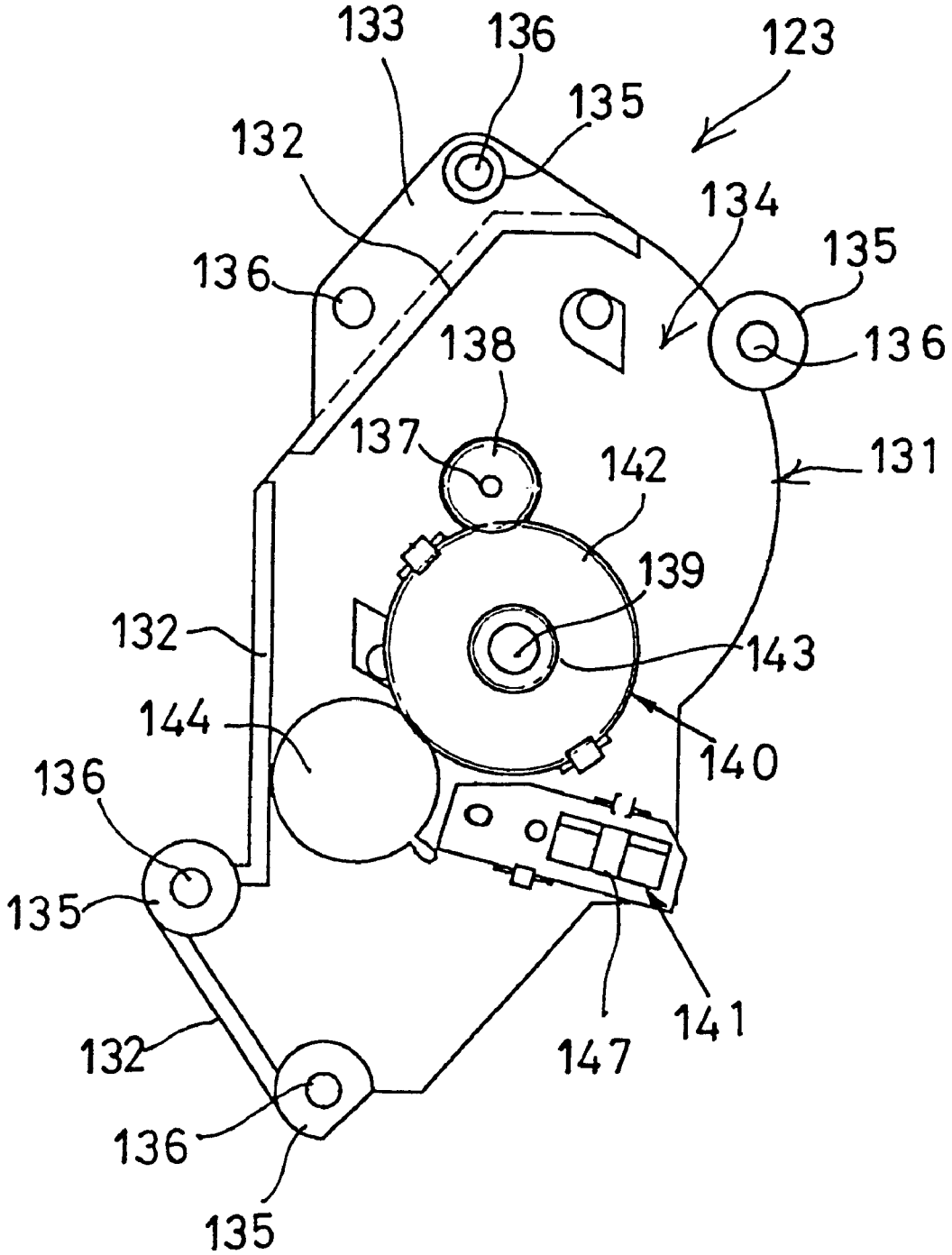
FIG. 23 is a back view of a power unit (normal posture)

FIG. 21 is a front view of the power unit 123, FIG. 22 is a side view of the power unit 123, and FIG. 23 is a back view of the power unit 123. The power unit 123 is provided with a mounting base 131 by which the power unit 123 is mounted to the printer body. A peripheral wall 132 is erected on the left side of the back face of the mounting base 131, a flange 133 is integrally formed on the upper peripheral wall 132, and a storage recess 134 is formed on the inside surrounded by the peripheral wall 132. Also, bosses 135 are provided at several locations along the periphery of the mounting base 131. The respective bosses 135 and the flange 133 are provided with mounting holes 136.

At the upper part on the surface of the mounting base 131, a drive motor M1 capable of being rotated in the normal and reverse directions is installed. A motor shaft 137 of the drive motor M1 penetrates to the storage recess 134 on the back face of the mounting base 131, and a drive gear 138 is integrally installed to the tip end of the motor shaft 137.

As shown in FIGS. 22 and 23, in the storage recess 134 of the mounting base 131, a support shaft 139, which is in parallel with the motor shaft 137, is projectingly provided under the motor shaft 137, and a transmission gear 140 meshing with the drive gear 138 is pivotally supported on the support shaft 139 so as to be rotatable. Under the transmission gear 140 is disposed a sensor 141, which consists of a transmission type photointerrupter.

The transmission gear 140 integrally has a large-diameter gear portion 142 on the base end side in the axial direction and a small-diameter gear portion 143 on the tip end side in the axial direction. The large-diameter gear portion 142 of the transmission gear 140 meshes with the drive gear 138 fixed to the motor shaft 137, so that the rotation is transmitted to the mating gear by the small-diameter gear portion 143 of the transmission gear 140. A power transmission mechanism is formed by the drive gear 138 and the transmission gear 140. In FIGS. 21 to 23, reference numeral 44 denotes a through hole formed in the mounting base 131, and 45 denotes a harness for the wiring of the drive motor M1 and sensor 141. The end of the harness 145 is connected to the control section CS via a connector.

The power unit 123 is assembled to the gap control mechanism 112 in the following manner. As shown in FIG. 18, the gap control lever 118 is set at the standard position, the power unit 123 in the normal posture shown in FIG. 21 is disposed at a predetermined position on the right side frame 2*a* from the outside face side of the gap control lever 118 with the side of the storage recess 134 facing the outside surface of the right side frame 2*a*. The small-diameter gear portion 143 of the transmission gear 140 on the side of the power unit 123 is engaged with the sector gear portion 121 of the gap control lever 118. The protrusion-shaped sensor portion 122 provided on the gap control lever 118 is inserted in a groove 147 of the sensor 141 on the side of the power unit 123. Then, small screws 146 are caused to pass through the mounting holes 136 so that the power unit 123 is screwed to the outside surface of the right side frame 2*a* (FIG. 15).

In the state in which the sensor portion 122 is inserted in the groove 147 of the sensor 141, the output signal of the sensor 141 is off, and the sensor 141 detects the standard position of the gap control lever 118 as the home position.

Now, the gap control lever 118 is assumed to be at the standard position. When the gap is widened, the motor shaft 137 of the drive motor M1 is rotated clockwise in FIG. 18. The drive gear 138 integral with the motor shaft 137 is rotated clockwise, and the transmission gear 150 meshing with the drive gear 138 is rotated counterclockwise, so that the counterclockwise rotation of the transmission gear 140 is transmitted to the sector gear portion 121 of the gap control lever 118 meshing with the transmission gear 140, by which a rotating body provided on the right side frame 2*a* and a rotating body provided on the left side frame 2*b* are turned clockwise integrally with the gap control lever 118. As a result, the carriage shaft 3, which is supported at an eccentric position with respect to the rotation centers of the right and left rotating bodies, is moved upward as indicated by reference numeral 3, in FIG. 18, so that the printing head 6 mounted on the carriage is separated upward from the platen 7, by which the gap is widened.

Also, along with the clockwise rotation of the gap control lever 118, the protrusion-shaped sensor portion 122 is also rotated clockwise, so that the sensor portion 122 gets out of the groove 147 of the sensor 141 on the side of the power unit 123, by which the output signal of the sensor becomes on (see reference numeral 122' in FIG. 18). When the gap control lever 118 is turned to the maximum position where the gap is at the maximum, the control section CS ceases the rotation of the drive motor M1.

Assuming that the gap control lever is at the maximum position, when the gap is narrowed, the motor shaft 137 of the drive motor M1 is rotated counterclockwise in FIG. 18. The rotating direction of the drive gear 138 and the transmission gear 140 in the power unit 123 becomes reverse to that of the normal rotation, and the rotating bodies provided on the right and left side frames 2*a* and 3 are turned counterclockwise integrally with the gap control lever 118. As a result, the carriage shaft 3, which is supported at an eccentric position with respect to the rotation centers of the right and left rotating bodies, is move downward from the position indicated by reference numeral 13', so that the printing head 6 mounted on the carriage approaches the platen 7 from the upside, by which the gap is narrowed.

Along with the counterclockwise rotation of the gap control lever 118, the protrusion-shaped sensor portion 122 is also rotated counterclockwise. When the gap control lever 118 is turned to the standard position, the sensor portion 122 goes into the groove 147 of the sensor 141 on the side of the power unit 123, so that the output signal of the sensor 141 turns from on to off. As a result, the home position is detected, and the rotation of the drive motor M1 is ceased by the control section CS (FIG. 18).

The power unit 123 is assembled to the paper course switching mechanism 115 in the following manner. The rocking plate 41 is set at the cut paper switching position as shown in FIG. 19, the power unit 123 is disposed at a predetermined position of the left side frame 2*b* from the side of the outside face of the rocking plate 41 in a reverse posture, in which the posture is substantially opposite vertically with respect to the normal posture shown in FIG. 21, with the side of the storage recess 134 facing the outside surface of the left side frame 2*b*. The small-diameter portion 143 of the transmission gear 140 on the side of the power unit 123 is engaged with the sector gear portion 26 of the rocking plate 41. The protrusion-shaped sensor portion 27 provided on the rocking plate 41 is inserted in the groove 147 of the sensor 141 on the side of the power unit 123. Then, small screws 146 are caused to pass through the mounting holes 136 so that the power unit 123 is screwed to the outside surface of the left side frame 2*b* (FIG. 16).

In the state in which the sensor portion 122 is inserted in the groove 147 of the sensor 141, the output signal of the sensor 141 is off, and the sensor 141 detects the position of the rocking plate 41 as the cut paper switching position.

When the paper course is switched from the cut paper course to the continuous paper course, the motor shaft 137 of the drive motor M1 is rotated clockwise in FIG. 19. The drive gear 138 integral with the motor shaft 137 is rotated clockwise, and the transmission gear 140 meshing with the drive gear 138 is rotated counterclockwise, so that the counterclockwise rotation of the transmission gear 140 is transmitted to the sector gear portion 26 of the rocking plate 41 meshing with the transmission gear 140, and the rocking plate 41 is turned clockwise integrally with the switching cam shaft 38.

As shown in FIG. 17, when the rocking plate 41 is turned clockwise, the column-shaped protrusion 28 of the rocking plate 41 is also turned clockwise, and the column-shaped protrusion 28 abuts on the top surface of the switching plate 11. Further, the column-shaped protrusion 28 pushes down the top surface of the switching plate 11 against the urging force of the urging spring so as to make the top surface of the switching plate 11 substantially horizontal. This horizontal posture forms the continuous paper course (FIG. 20).

Also, along with the clockwise rotation of the rocking plate 41, the protrusion-shaped sensor portion 27 is also rotated clockwise, so that the sensor portion 27 gets out of the groove 147 of the sensor 141 on the side of the power unit 123, by which the output signal of the sensor 141 becomes on (reference numeral 27' in FIG. 19). When the rocking plate 41 is turned to the continuous paper switching position, the control section CS ceases the rotation of the drive motor M1.

Also, when the paper course is switched from the continuous paper course to the cut paper course, the motor shaft 137 of the drive motor M1 is rotated counterclockwise in FIG. 19. The rotating direction of the drive gear 138 and the transmission gear 140 in the power unit 123 becomes reverse to that of the normal rotation, and the rocking plate 41 is turned counterclockwise integrally with the switching cam shaft 38.

As shown in FIG. 20, when the rocking plate 41 is turned counterclockwise, the column-shaped protrusion 28 of the rocking plate 41 is also turned counterclockwise. When the column-shaped protrusion 28 moves upward from the top surface of the switching plate 11, the switching plate 11 is pulled upward by the urging force of the urging spring, so that the paper course is switched to the cut paper course, in which the tip end of the switching plate 11 points upward obliquely.

As shown in FIG. 19, along with the counterclockwise rotation of the rocking plate 41, the protrusion-shaped sensor portion 27 is also rotated counterclockwise. When the rocking plate 41 is turned to the cut paper switching position, the sensor portion 27 goes into the groove 147 of the sensor 141 on the side of the power unit 123, so that the output signal of the sensor 141 turns from on to off. As a result, the cut paper switching position of the rocking plate 41 is detected, and the rotation of the drive motor M1 is ceased.

An ink ribbon cassette installation construction will be described below with reference to FIGS. 24 to 29.

Figure 24:
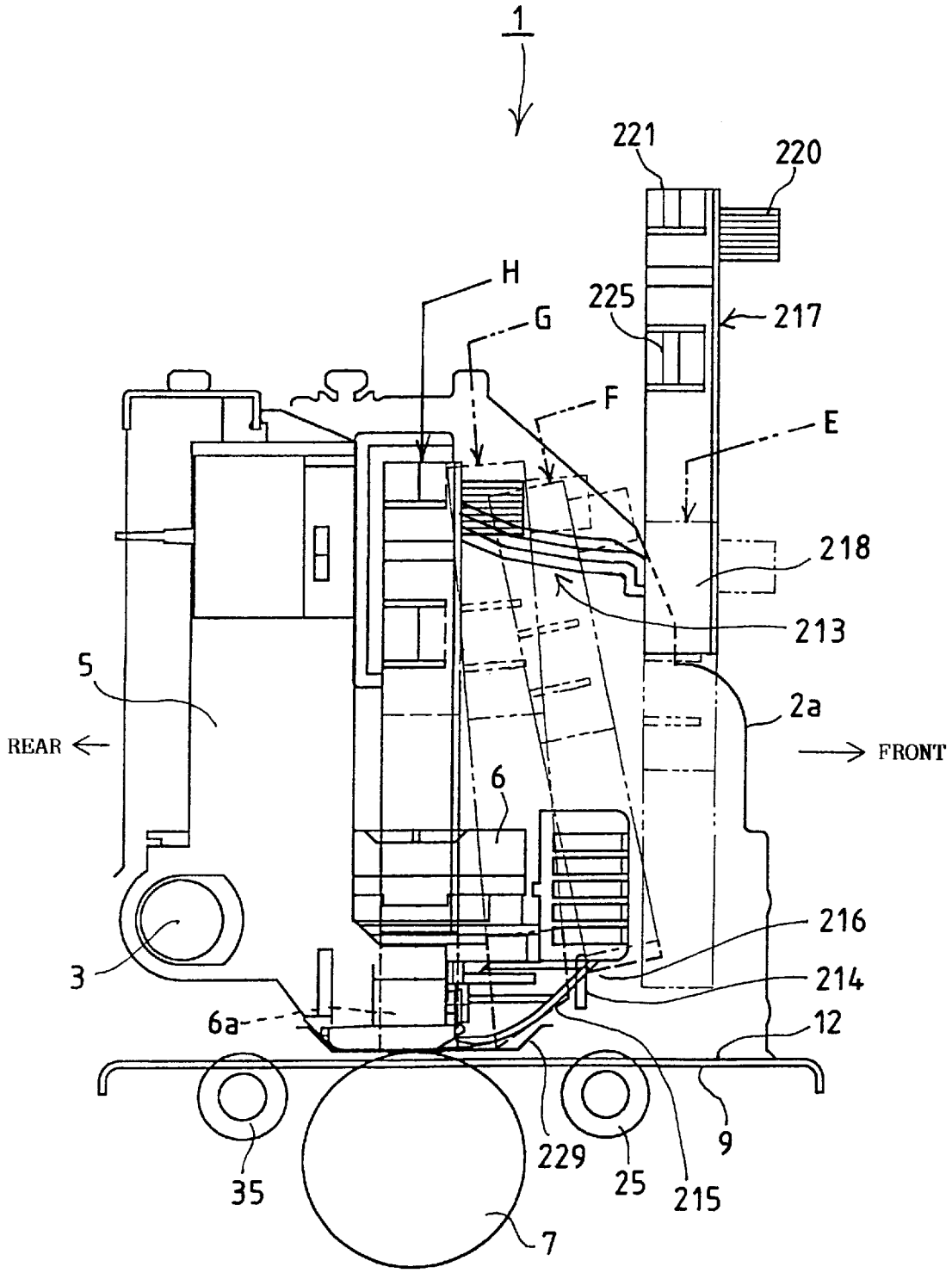
Figure 25:
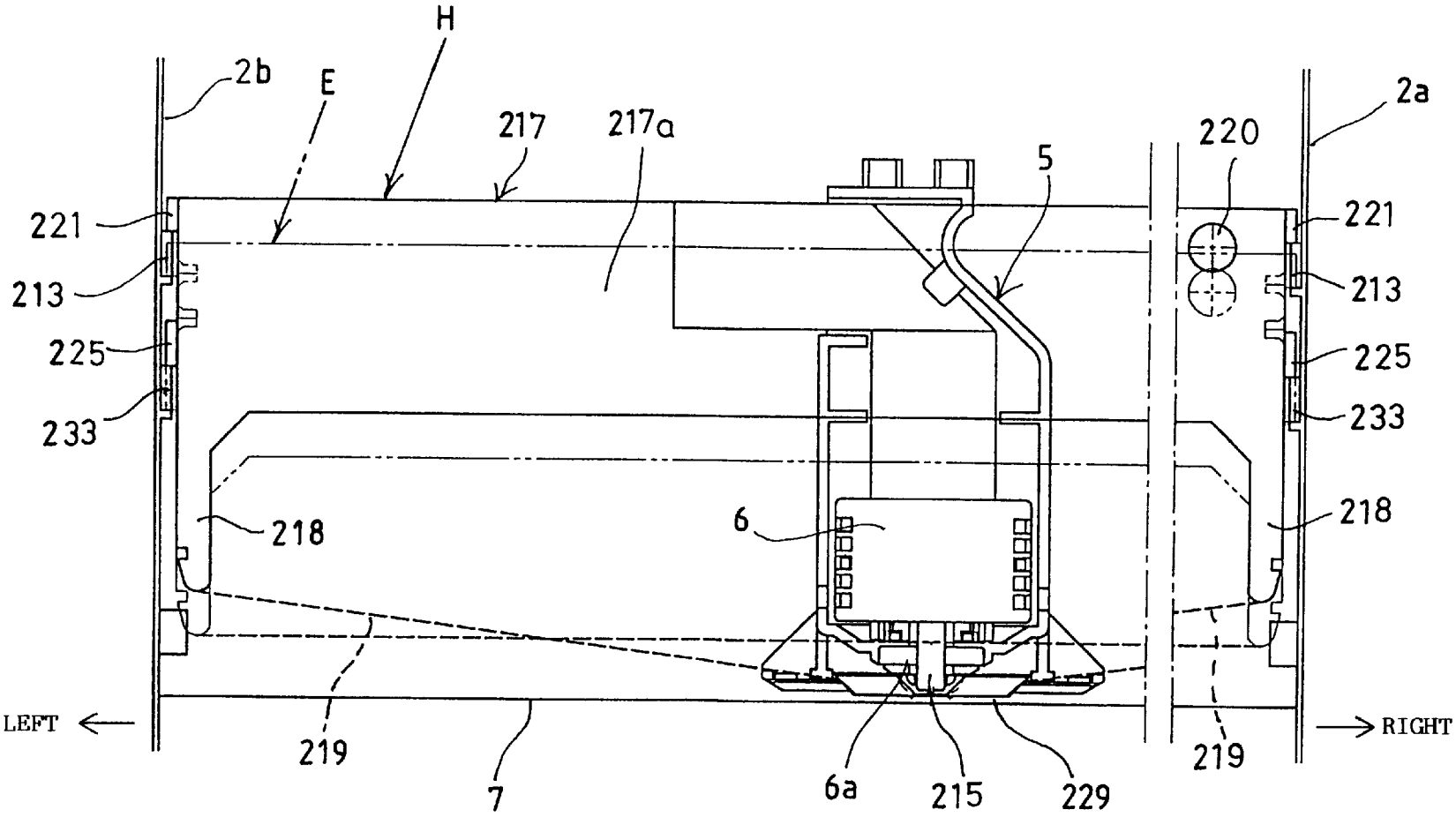
FIG. 25 is a front view of a principal portion of a printer, showing an installation state of an ink ribbon cassette.

FIG. 24 is a schematic side view of the printer 1, shown by seeing through, and FIG. 25 is a front view of a principal portion of the printer, showing an installation state of an ink ribbon cassette. In FIG. 24, the right side is the front of the printer 1, and the left side is the rear thereof FIGS. 24 and 25 show a first embodiment of the ink ribbon cassette installation construction.

Above the rear part of the transfer plate 9, a carriage shaft 9 is transversely mounted between the side frames 2*a* and 2*b* in a horizontal manner, and the carriage 10 is fitted to the carriage shaft 9 so as to be movable between the side frames 2*a* and 2*b* in the transverse direction. On the front face of the carriage 10 is installed the printing head 11 with the printing portion 12 facing the platen disposed below the printing head 11.

On the inside surfaces of the side frames 2*a* and 2*b*, respective inclined guide rails 213 are provided substantially in the center of the height so as to be opposed to each other. At the lower portions of the inside surfaces of the side frames 2*a* and 2*b*, respective regulating protrusions 214 are provided so as to be opposed to each other. Also, at the lower portion of the printing head 11, a ribbon guide 215 is provided, which is inclined obliquely toward the front from the ink ribbon mounting position on the lower end face of the head portion 12. The front end lower side of the ribbon guide 215 constitutes an insertion port 216 for a ribbon 219.

Reference numeral 29 denotes a ribbon mask installed on the front face of the head portion 12 of the printing head 11. The ribbon 219 is mounted between the ribbon guide 215 and the ribbon mask 229.

The inclined guide rail 213 is formed by a ridge, and the rear portion thereof is higher than the front portion thereof, that is, the inclined guide rail 213 is inclined so as to rise from the front portion to the rear portion. Also, the regulating protrusion 214 is disposed at a position facing the insertion port 216 of the ribbon guide 15 provided on the printing head 11, seen through transversely. The position of the regulating protrusion 214 is a position such that when a cassette 217 is mounted, the lower end portion of the cassette 217 faces the regulating protrusion 214.

Figure 26:
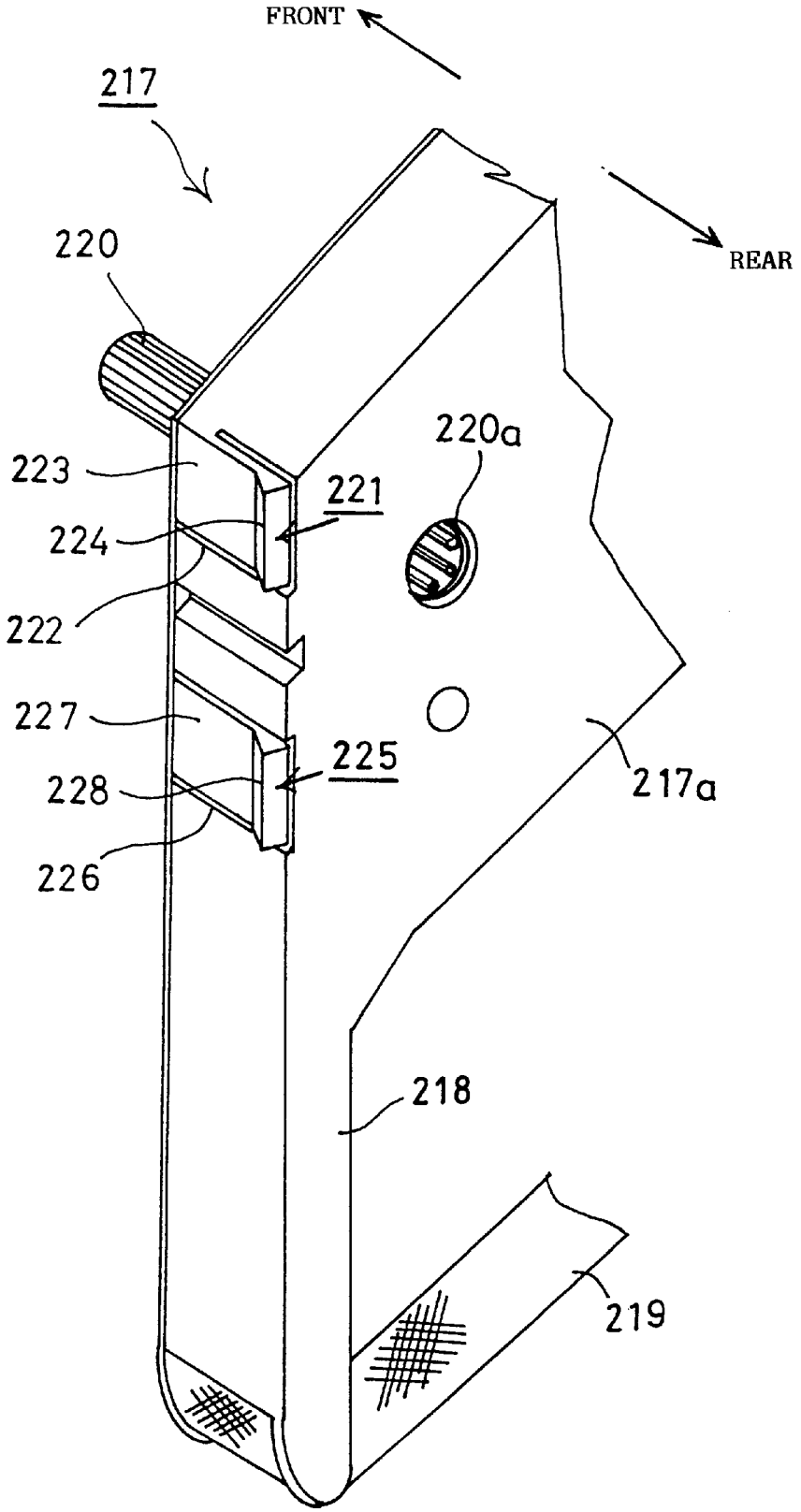
FIG. 26 is a perspective view showing a principal portion of an ink ribbon cassette.

As shown in FIGS. 25 and 26, the cassette 217, which is long in the transverse direction, is provided with arm portions 218 extending downward on both right and left sides, and has the ribbon 219 extendedly mounted between the tip end portions of the arm portions 219. The ribbon 219, stored in a ribbon storage portion 217*a*, circulates between the arm portions 218 as an exposed face. At the upper right corner of the front face of the cassette 217, a winding rotation knob 220 for winding the ribbon 219 manually is provided. On the back face of the cassette 217, an insertion hole 20*a* for inserting a ribbon feed shaft (not shown) provided on the side of the printer 1 is formed coaxially with the winding rotation knob 220.

As shown in FIGS. 24 and 25, recesses 222 are formed in the central upper portions of the right and left side faces of the cassette 217, and an elastic piece 223 is provided from the side face front part of the cassette 217 toward the side face rear part thereof. Also, a claw 224 extending in a chevron shape is integrally formed in the tip end portion of the elastic piece 224. Under the recess 222 is provided a recess 226, which also has an elastic piece 227 and a claw 228 at the tip end of the elastic piece 227 in the same way.

The upper portion described here is an upper portion in the state in which the cassette 217 is erected so that the ribbon storage portion 217*a* is vertical (the same applies hereinafter). These claws 224 are used so that when the cassette 217 is pushed into the mounting position, the claws 224 are fitted into the holes formed in the right and left frames 2*a* and 2*b* to keep the cassette 217 at that position. In this embodiment, the claws 224 are also used as guide protrusions 221.

Also, the claws 228 are used as the second guide protrusions 225 in other embodiments (described later).

The cassette 217 is arranged so that the guide protrusions 221 thereof are supported on the inclined guide rails 213 on both sides, and is mounted between the side frames 2*a* and 2*b* of the printer.

At this time, the ribbon 219 is mounted to the printing portion 12 of the printing head 11 as described below. In FIG. 24, reference characters E, F, G and H denote the positions and postures of the cassette 217 along the travel path when the cassette 217 is mounted. Also, the ribbon 219 is kept in a state in which the looseness is eliminated by turning the winding rotation knob 20 provided on the cassette 217.

(Step 1)

The cassette 217 is held in a vertical posture such that the ribbon 219 faces downward, moved downward as it is, and set in front of the printing head 11 (reference character E in FIG. 24).

(Step 2)

The cassette 217 is moved rearward until the guide protrusions 221 are put on the guide rails 13. Further, the cassette 217 is moved from the front to the rear along the inclination of the inclined guide rails 213. Thereby, the lower end portion of the cassette 217, that is, the lower end portions of arm portions 218 abut on the regulating protrusions 214 provided on the inside surfaces of the right and left side frames 2*b* and 2*a*. Therefore, the rearward movement of the lower portion of the cassette 217 is regulated and only the upper portion moves rearward, so that the cassette 217 assumes a posture such that the upper portion is inclined rearward with respect to the lower portion. The face of the ribbon 219 in the cassette 217 is low at the rear and high at the front. The inclination of the cassette 217 agrees with the inclination of the ribbon guide 215 (reference character F in FIG. 24).

(Step 3)

The cassette 217 is further moved rearward. Thereby, the guide protrusions 221 move upward along the inclined guide rails 213, and the lower end portion of the cassette 217 gets over the regulating protrusions 214 provided on the side frames 2*a* and 2*b*. In this state, the ribbon 219 comes near the ribbon insertion port 216 of the ribbon guide 215 in a posture along the insertion direction of the insertion port 216 (reference character F in FIG. 24).

(Step 4)

Since the regulation to the lower end portion of the cassette 217 is eliminated after the lower end portion of the cassette 217 gets over the right and left regulating protrusions 214, 214, the ribbon 219 enters the insertion port 216 of the ribbon guide 215.

Further, the cassette 217 is pushed in rearward along the inclination of the inclined guide rails 213. Thereby, the cassette 217 moves to the rear part of inclined guide rails 213, and also moves upward. The ribbon 219 moves rearward by being guided along the inclination of the ribbon guide 215, and also is pulled out downward (reference character G in FIG. 24), and is set at the mounting position on the lower end face of the printing portion 12.

The cassette 217 assumes a posture such that the ribbon storage portion 217*a* is vertical (reference character H in FIG. 24).

(Step 5)

The upper and lower portions of the cassette 217 are pushed in parallel in the same way so that the claws 224 (guide protrusions 221) are fitted in the holes formed in the right and left frames 2 and 3, by which the cassette 217 is finally mounted between the side frames 2*a* and 2*b*.

According to the above-described installation construction of the cassette 217, at the time of the mounting of the cassette 217, when the guide protrusions 221 of the cassette 217 are moved from the front toward the rear along the inclined guide rails 213, the lower end portion of the cassette 217 is caused to abut on the regulating protrusions 214 to temporarily regulate the lower portion, and the cassette 217 assumes a posture such that the upper portion thereof is inclined rearward with respect to the lower portion. Thereby, the face of the ribbon 219 is inclined so that the face is low at the rear and high at the front, so that the ribbon 219 can assume a posture along the insertion direction of the insertion port 216. Thereupon, the ribbon 219 can easily be introduced to the ribbon insertion port 216 of the ribbon guide 215 provided on the printing head 11. Further, the ribbon 219 is guided smoothly to the mounting face along the inclination of the ribbon guide 215, and unsuccessful mounting of the ribbon 219, such as being twisted or turned up, can be prevented.

Figure 27:
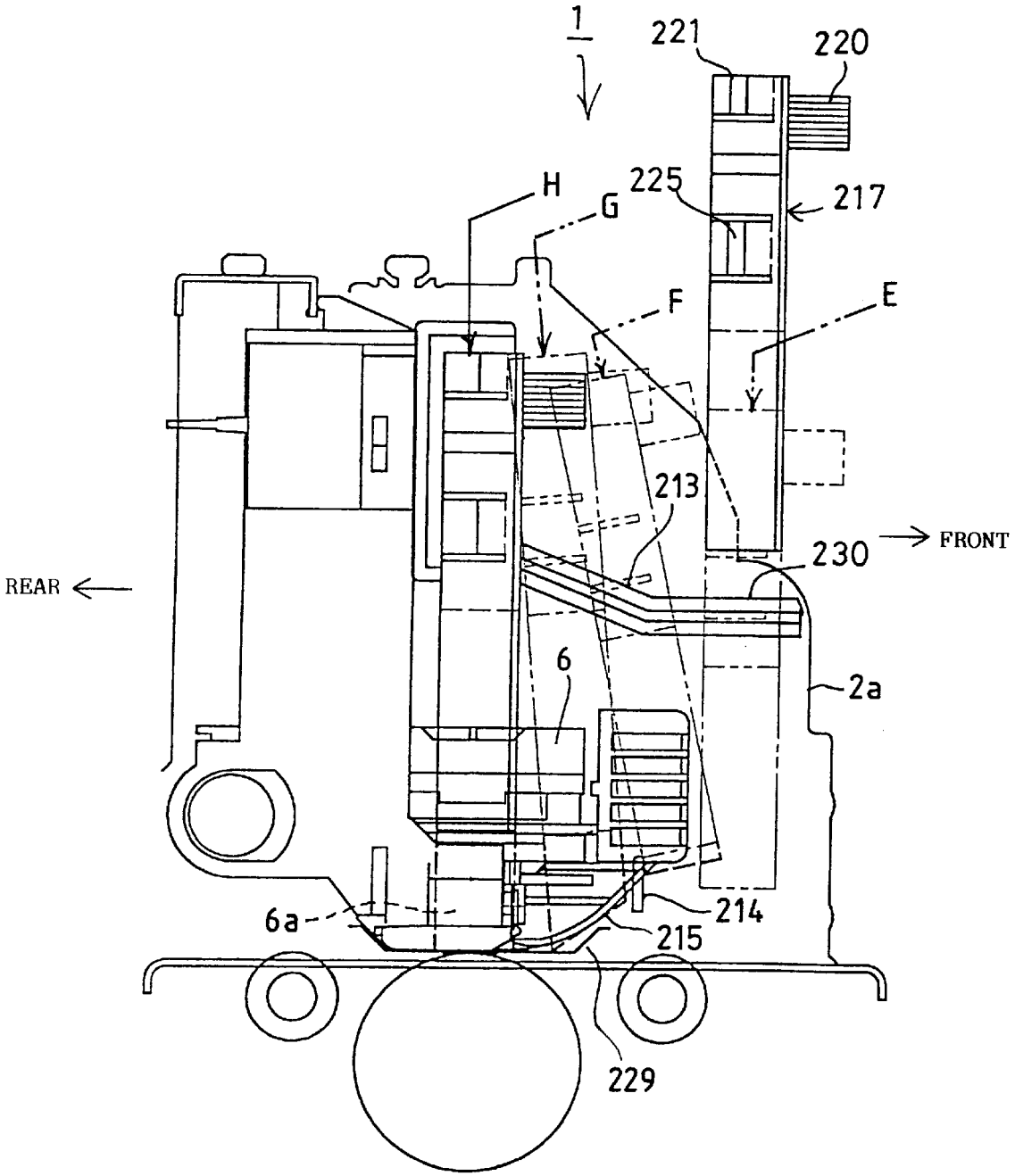

FIG. 27 is a schematic side view of the printer 1, for illustrating a second embodiment of the cassette installation construction.

The second embodiment differs from the first embodiment in that horizontal guide rails 230 are disposed on the inside surfaces of the side frames 2*a* and 2*b*. The horizontal guide rail 230 is provided continuously with the front side of the inclined guide rail 213, and is arranged so that the lower end of the cassette 217 is at almost the same height as the insertion port 216 of the ribbon guide 215 in a state of supporting the second guide protrusions 221.

According to this construction, the guide protrusions 221 of the cassette 217 are supported on the horizontal guide rails 230 in step 1. Thus, the cassette 217 is positioned vertically, and the ribbon 219 extendedly mounted at the lower end portion of the cassette 217 comes at almost the same height as the insertion port 216 of the ribbon guide 215, so that the ribbon 219 can easily be arranged at this position. In the case of the first embodiment, in step 1, the cassette 217 must be kept in proper posture and position until the guide protrusions 221 are supported on the inclined guide rails 213.

Also, if the horizontal guide rail 30 is provided integrally and continuously with the inclined guide rail guide rail 13 as shown in FIG. 27, the movement of the ribbon 219 to the mounting face of the printing portion 12 can be effected continuously and smoothly after the ribbon 219 of the cassette 217 is arranged at almost the same height as the insertion port 216 of the ribbon guide 215.

Figure 28:
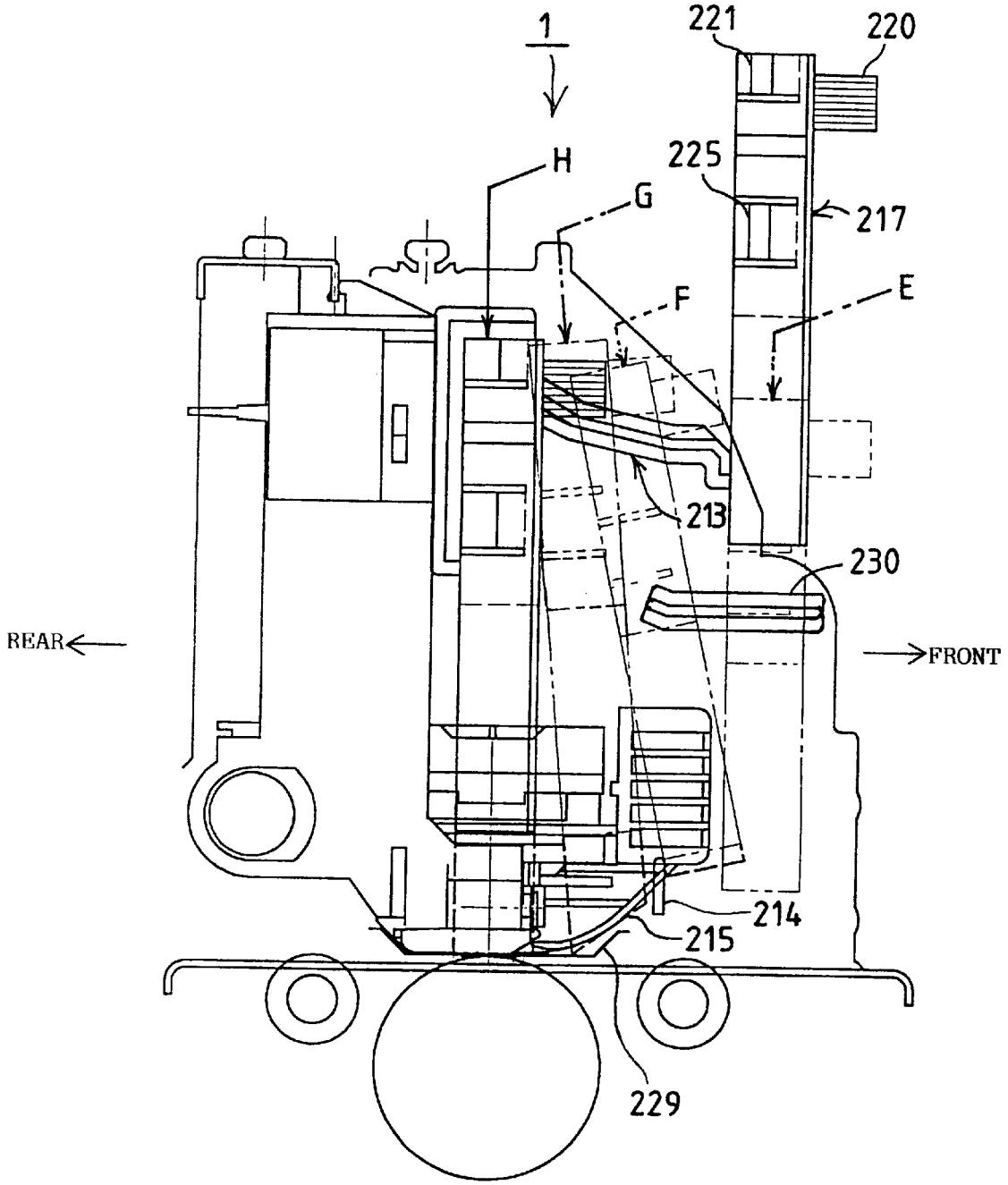

FIG. 28 shows a third embodiment. In this embodiment, the horizontal guide rail 230 is formed in front of the inclined guide rail 213 with a vertical distance between them.

In this case, in addition to the guide protrusions 221 of the cassette 217 which are guided by the inclined guide rails 13, the second guide protrusions 25 which are guided by the horizontal guide rails 230 are used.

The second guide protrusion 25 uses the claw 228, which is similar to the claw 224 and is formed under the claw 224, as a guide protrusion. Since other constructions are the same as those of the second embodiment, detailed description is omitted.

According to this construction, by supporting the second guide protrusions 225 on the horizontal guide rails 230, the vertical position of the cassette 217 can be determined. Then, by transferring the cassette 217 rearward, the first guide protrusions 221 can be put on the inclined guides 13. The mounting procedure succeeding to this is the same as that in the second embodiment.

Figure 29:
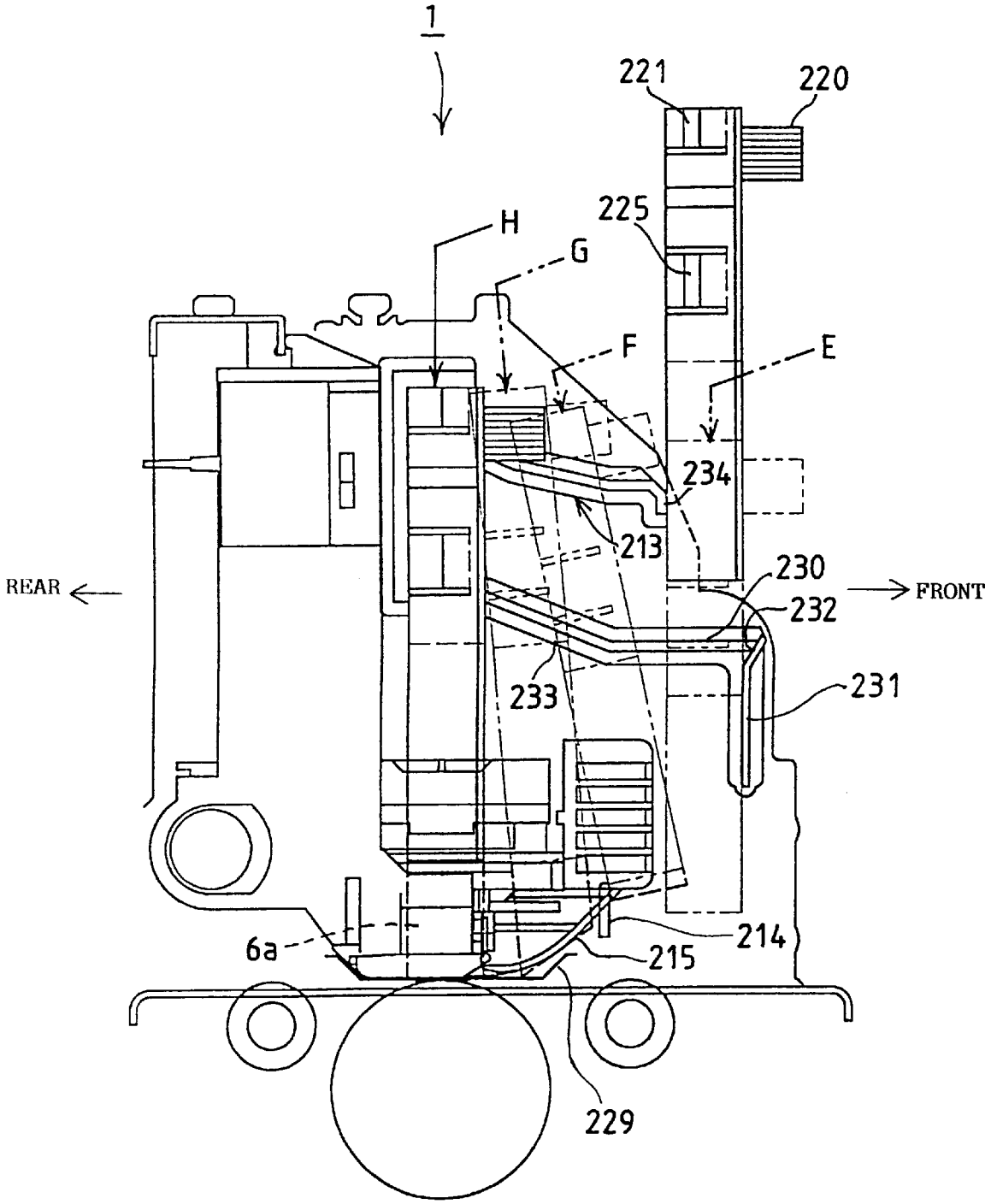
Figure 30:
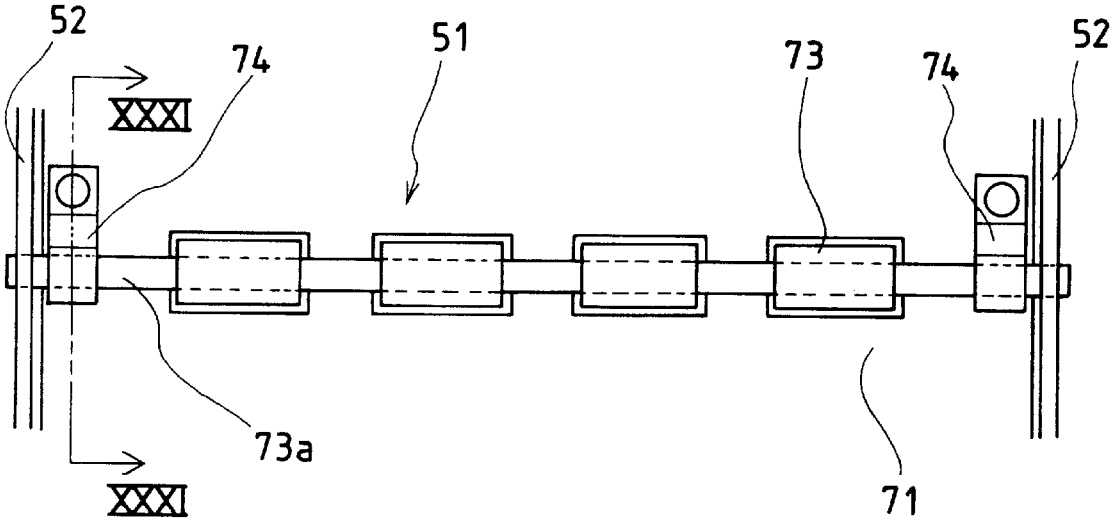
FIG. 30 is a plan view showing an arrangement of pressing rollers in a paper feed device for a conventional printer.
Figure 31:
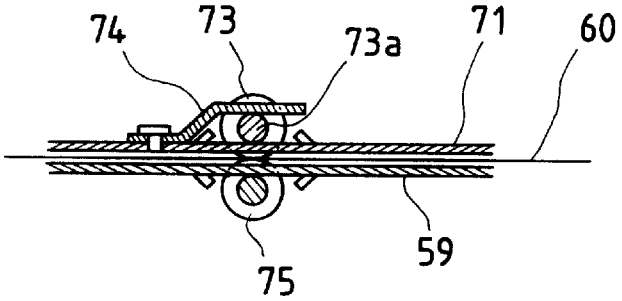
FIG. 31 is a sectional view taken along the line XXXI—XXXI of FIG. 30.

FIG. 29 is a schematic side view of the printer 1, for illustrating a fourth embodiment of the cassette installation construction.

In the fourth embodiment, in addition to the inclined guide rail 213 and the horizontal guide rail 230, a vertical guide 231 is provided on the inside surface of the respective right and left side frames 2 and 3. The vertical guides 231 guide the front face of the cassette 217 in a posture such that the ribbon 219 faces downward on both of right and left sides. Also, an auxiliary guide rail 233 is provided continuously at the rear of the horizontal guide rail 230. Further, the vertical guide 31 is provided integrally and continuously with the horizontal guide rail 230 at the lower part of the front end of the horizontal guide rail 230. The upper end of the vertical guide 231 forms a receiving face 34 bent frontward obliquely.

Also, a sub-vertical guide 234 facing downward is provided at the front end of the inclined guide rail 13 on the inside surface of the respective right and left side frames 2 and 3. The distance between the front face of the sub-vertical guide 234 and the rear face of the vertical guide 231 is approximately equal to or slightly larger than the thickness of the cassette 217.

The ribbon 219 is mounted as described below.

(Step 1)

The cassette 217 is slid between the vertical guide 231 and the sub-vertical guide 234 from the lower end while keeping a posture such that the ribbon 219 faces downward (E in FIG. 29). The vertical movement of the cassette 217 can be effected smoothly because the rear face and the front face are guided by the vertical guide 231 and the sub-vertical guide 234, respectively. When the second guide protrusions 25 are put on the horizontal guide rails 230, the cassette 217 is supported at this position, and the position of the ribbon 219 agrees with the position of the insertion port 216 of the ribbon guide 215.

(Step 2)

The cassette 217 is pushed out from the front to the rear. Initially, the second guide protrusions 25 slide and move on the horizontal guide rails 230, and then the first guide protrusions 221 located above are put on the inclined guide rails 213. Also, the lower portion of the cassette 217 collides with the regulating protrusions 214.

(Step 3)

The cassette 217 is further moved rearward. Since the lower portion of the cassette 217 cannot move because of the presence of the regulating protrusions 214, only the upper portion moves, so that the cassette 217 is inclined in a posture such that the upper portion is at the rear and the lower portion is at the front. Therefore, the ribbon 219 becomes in an inclined state such that the ribbon face is low at the rear and high at the front. This inclination agrees with the inclination of the ribbon guide 215.

(Step 4)

The cassette 217 is further pushed rearward. Then, since the first guide protrusions 221 located above rise on the inclined guide rails 213, the lower portion of the cassette 217 is disengaged from the regulating protrusions 214, so that the lower portion moves rearward by the gravity.

When the cassette 217 is further pushed rearward, since the movement of the lower portion of the cassette 217 is regulated, the inclination is increased, so that the rearward movement of the whole cassette is liable to become difficult. In the construction of the fourth embodiment, however, when the cassette 217 is inclined to some degree, the second guide protrusions 25 come into contact with the auxiliary guide rails 233, so that further inclination is prevented. Therefore, the cassette 217 can move in parallel smoothly while being inclined.

When the lower portion of the cassette 217 is disengaged from the regulating protrusions 214 and moved rearward by the gravity, the ribbon 219 slides between the ribbon guide 19 and the ribbon mask 229. When the ribbon 219 slides between them, the ribbon face of the ribbon 219 substantially agrees with the guide direction of the ribbon guide 215, so that the ribbon 219 is guided smoothly without being twisted or turned up.

(Step 5)

The cassette 217 is further pressed. Since the upper portion reaches the mounting position, the inclined state is gradually released. When the ribbon 219 in the lower portion reaches the position of the printing portion 12, the claws 224 and 28 (first and second guide protrusions 221 and 25) in the upper portion fit in the holes formed in the side frames 2*a* and 2*b*, and this position is kept. Thereby, the mounting of the cassette 217 is finished.

The above is a description of a case where the inclined guide rail 213, horizontal guide rail 230, and the like are formed by a ridge. However, the same applies in a case where these are formed by a groove. Also, although the claws 224 and 228 are used as the guide protrusions to mount the cassette 217 on the side frames 2*a* and 2*b* in the above embodiments, other portions projecting from both side faces of the cassette 217 may be used. Further, such portions may be provided specially, not being used for other purposes as well.

As described above, according to the type printer in accordance with the present invention, the printing paper can be removed from the transfer path by rocking the pressing roller together with the roller holding member and the rocking frame. Therefore, jamming printing paper on the transfer path can removed easily. Also, the attachment and detachment of the ink ribbon cassette and printing head can be performed easily.

The pressing force of the pressing roller on the paper feed roller can be applied by one pressing spring, and at the same time the rocking frame can be positioned steadily. Therefore, the number of parts can be reduced.

The rocking frame can easily be attached and detached at a predetermined angle, and a trouble such that the rocking frame comes off at an angle other than the predetermined angle can be avoided.

Further, the distance from the pressing roller to the switching cam shaft can be shortened, so that the depth of the whole printer having the printing modes of continuous paper and cut paper can be decreased.

Also, since the operating member for performing the switching operation of the end portion of switching cam shaft is provided, the rocking operation of the switching cam can be performed easily.

The paper course switching mechanism between the continuous paper printing mode and the cut paper printing mode can be realized by a simple construction.

By changing the position of the stopper pin, the rocking position of the switching plate in the cut paper printing mode can be changed easily.

The tractor drive transmission mechanism can be realized by a simple construction.

The same power unit can be used commonly for the electrical driving of both of the gap control mechanism and the paper course switching mechanism, so that the manufacturing cost can be decreased as compared with the case where a special-purpose power unit installed for the gap control and a special-purpose power unit installed for the switching of paper course are prepared.

By merely assembling the power unit to a printer shipped as a type such that the gap control mechanism and the paper course switching mechanism are operated manually, the printer can easily be remodeled into an electrically-driven type.

Since the detection of home position, which is necessary for an electrically-driven printer, is carried out by the sensor provided on the side of the power unit, remodeling can be performed in a short period of time when the gap control mechanism and the paper course switching mechanism are changed from a manually-operated type to an electrically-driven type.

What is claimed is:

1. A printer, comprising:

a paper feeding mechanism for feeding a paper along a substantially straight transfer path;

a carriage provided movable to reciprocate in a direction substantially perpendicular to a paper feeding direction of said paper feeding mechanism;

a printing head attached to said carriage;

a cylindrical platen disposed to confront said printing head with the paper fed by said paper feeding mechanism therebetween in said substantially straight transfer path; and a driving mechanism for driving said platen and said paper feeding mechanism, said driving mechanism including a single driving motor and a gear train for transmitting rotation of said single driving motor to said platen and said paper feeding mechanism so that rotation of said platen and paper feed by said paper feeding mechanism are synchronized with each other, thereby positions of impacts on a peripheral surface of said platen by said printing head are distributed over a whole region on the peripheral surface of said platen.

2. A printer, comprising:

a paper feeding mechanism for feeding a paper along a substantially straight transfer path;

a carriage provided movable to reciprocate in a direction substantially perpendicular to a paper feeding direction of said paper feeding mechanism;

a printing head attached to said carriage;

a cylindrical platen disposed in confronting relation to said printing head; and a driving mechanism for driving said platen and said paper feeding mechanism, said driving mechanism including a single driving motor and a gear train for transmitting rotation of said single driving motor to said platen and said paper feeding mechanism so that rotation of said platen and paper feed by said paper feeding mechanism are synchronized with each other, thereby positions of impacts on a peripheral surface of said platen by said printing head are distributed over a whole region on the peripheral surface of said platen;

wherein said paper feeding mechanism comprising paper feed rollers provided on both sides of said platen in the paper feeding direction, and pressing rollers provided in confronting relation to said paper feed rollers, for pressing a paper towards said paper feed rollers.

3. A printer according to claim 2, further comprising a tractor for transferring a continuous paper.

4. A printer according to claim 3, further comprising a pressing force varying mechanism for vary the pressing force of said pressing roller.

5. A printer according to claim 4, wherein operation mode of said printer is switchable by a switching means between a continuous paper printing mode for printing on a continuous paper by driving said tractor, and a cut paper printing mode for printing on a cut paper without driving said tractor.

6. A printer according to claim 5, wherein the pressing force of said pressing roller are different in the continuous paper printing mode and in the cut paper printing mode, and the pressing force is changed in response to switching between the continuous paper printing mode and the cut paper printing mode.

7. A printer according to claim 6, wherein the pressing force of said pressing roller in the continuous paper printing mode is set smaller than the pressing force in the cut paper printing mode.

8. A printer according to claim 7, further comprising different paper transfer paths for a continuous paper and for a cut paper, and a paper transfer path switching mechanism for directing the cut paper and the continuous paper to pass through the respective paper transfer paths.

9. A printer according to claim 8, wherein said paper transfer path switching mechanism is switched in response to the switching between the continuous paper printing mode and the cut paper printing mode.

10. A printer according to claim 8, wherein the switching of the pressing force of the pressing roller by said pressing force varying mechanism and the switching of the paper transfer path by said paper transfer path switching mechanism are simultaneously performed in response to the switching between the continuous paper printing mode and the cut paper printing mode.

11. A printer according to claim 10, said printer further comprising a first frame on which said paper feed roller is supported and a second frame on which said pressing roller is supported, wherein said second frame is supported rotatable with respect to said first frame to enable the pressing roller separated from the paper feed roller by rotating said second frame.

12. A printer according to claim 11, further comprising a gap control mechanism for moving the printing head to be brought close to or separated from the platen in order to control a gap between the printing head and the platen.

13. A printer according to claim 12, further comprising a power unit assembled to said gap control mechanism, for driving said gap control mechanism, said power unit having a motor and a power transmission mechanism supported on a mounting base.

14. A printer according to claim 13, wherein said power unit is capable of being assembled to said paper transfer path switching mechanism, for driving said paper transfer path switching mechanism.

15. A printer, comprising:

a substantially straight paper transfer path;

a carriage provided movable to reciprocate in a direction substantially perpendicular to a paper feeding direction in said paper transfer path;

a printing head attached to said carriage;

a cylindrical platen disposed in confronting relation to said printing head; and paper feed rollers;

wherein said printing head, said platen and said paper feed rollers are arranged in said paper transfer path, and said platen and said paper feed rollers are driven by a single driving motor so that said platen rotates in synchronism with paper fed by said paper feed rollers, thereby positions of impacts on a peripheral surface of said platen by said printing head are distributed over a whole region on the peripheral surface of said platen.

* * * * *